US007034217B2

(12) United States Patent
Pachet

(10) Patent No.: US 7,034,217 B2
(45) Date of Patent: Apr. 25, 2006

(54) AUTOMATIC MUSIC CONTINUATION METHOD AND DEVICE

(75) Inventor: François Pachet, Paris (FR)

(73) Assignee: Sony France S.A., Clichy (FR)

( * ) Notice: Subject to any disclaimer, the term of this patent is extended or adjusted under 35 U.S.C. 154(b) by 113 days.

(21) Appl. No.: 10/165,538

(22) Filed: Jun. 7, 2002

(65) Prior Publication Data

US 2002/0194984 A1 Dec. 26, 2002

(30) Foreign Application Priority Data

Jun. 8, 2001 (EP) ..... 01401485
Apr. 5, 2002 (EP) ..... 02290851

(51) Int. Cl.
*G10H 7/00* (2006.01)

(52) U.S. Cl. ..... 84/609; 84/645

(58) Field of Classification Search ..... 84/645, 84/611, 612, 626, 609
See application file for complete search history.

(56) References Cited

U.S. PATENT DOCUMENTS

| | | | | |
|---|---|---|---|---|
| 5,418,323 | A * | 5/1995 | Kohonen | 84/609 |
| 5,521,324 | A * | 5/1996 | Dannenberg et al. | 84/612 |
| 5,606,144 | A * | 2/1997 | Dabby | 84/649 |
| 5,696,343 | A * | 12/1997 | Nakata | 84/609 |
| 5,736,666 | A | 4/1998 | Goodman et al. | |
| 5,808,219 | A * | 9/1998 | Usa | 84/600 |
| 5,990,407 | A | 11/1999 | Gannon | |
| 6,384,310 | B1 * | 5/2002 | Aoki et al. | 84/609 |
| 6,658,309 | B1 * | 12/2003 | Abrams et al. | 700/94 |

FOREIGN PATENT DOCUMENTS

| | | |
|---|---|---|
| WO | WO 99 46758 | 9/1999 |
| WO | WO 01 09874 | 2/2001 |

OTHER PUBLICATIONS

Pachet. Francois. "Surprising Harmonies." International Journal on Computing Anticipatory Systems. 1999. pp. 1-20.

"Automatic Modeling of Musical Style" O. Lartillot et al. (International Computer Music Conference—Sep. 17, 2001).

* cited by examiner

*Primary Examiner*—Jeffrey W Donels
(74) *Attorney, Agent, or Firm*—Frommer Lawrence & Haug LLP; William S. Frommer; Thomas F. Presson

(57) ABSTRACT

The invention allows to generate music as a real time continuation of an input sequence of music data, through a continuation phase comprising the steps of:

detecting the occurrence of an end of a current input sequence of music data (12), and starting to generate said continuation upon the detected occurrence of an end of a current input sequence of music data.

The data rate of the current input sequence of music data can be determined so as to time the start of the continuation substantially in phase with the determined data rate such that the transition from an end of the current input sequence to the starting of the continuation is substantially seamless.

The start portion of the generated continuation can be selected from a learnt input sequence which contains the terminal portion of the current input sequence up to the detected end and which has an identified continuation therefor, when such a learnt sequence is found to exist, such that a concatenation of the terminal portion and the start portion forms a data sequence contained in said learnt sequence.

55 Claims, 6 Drawing Sheets

AUTOMATIC MUSIC CONTINUATION METHOD AND DEVICE

The invention relates to a device and process for automatically continuing a music sequence from the point where the latter is interrupted, for instance to follow on seamlessly and in real time from music produced at an external source, e.g. a musical instrument being played live.

It can serve to simulate an improvising performing musician, capable for instance of completing a musical phrase started by the musician, following on instantly with an improvisation that takes into account the immediate musical context, style and other characteristics.

In this respect, the invention contrasts with prior computerised music composing systems, which can be classed into two types:

i) systems which compose on demand autonomous musical pieces in the manner of a certain composer, performing artist or musical genre, but which do not adapt coherently to a live musical environment; and ii) "question-answer" type systems, i.e. in which a player inputs a music sequence and the system replies with a complementary music sequence. The latter is an improvisation influenced by the player input, but forms an independent musical item with a clear break point marking the switch from the player input (question) to the artificially generated response (answer).

Musical improvisation, especially in Jazz, is both a fascinating activity and a very frustrating one. Improvisation by a human musician requires an intimate relationship between musical thought and sensory-motor processes: the musician must listen, think, develop ideas and move his/her fingers very quickly. Speed and lack of time are crucial ingredients of improvisation; it is what makes it exciting. It is also what makes it frustrating: beginners as well as experienced improvisers are by definition limited by their technical abilities, and by the morphology of the instrument.

The invention can overcome this hurdle by creating meta instruments which address this issue explicitly: providing fast, efficient and enhanced means of generating interesting improvisation, in a real-world, real-time context.

Music improvisation has long been an object of numerous studies, approaches and prototypes, using virtually all the computer techniques at hand.

In the present context, these approaches can be divided into two categories: interactive systems and intelligent music composition systems.

Schematically, interactive music systems propose ways of transforming quickly musical input into musical output. Such systems have been popular both in the experimental field (cf. Robert "Interactive Music Systems" (1993), MIT PRES, and William F. Walker "A composer participant in musical improvisations", Proc. Of CHI 1997, ACM Press, 1997), as well as in commercial applications, from one-touch chords of arranger systems to music workstations, such as disclosed in "Karma Music Workstation, basic guide", Korg, Inc. downloadable from URL http://www.korg.com/downloads/pdf/KARMA_BG.pdf (2001).

While much work has been devoted to efficient controllers and interfaces for musical systems (cf. Jan Borchers "Designing interactive musical systems: a pattern approach", HCI International '99. 8$^{th}$ International Conference on Human-Computer Interaction, Munich, Del., Aug. 22–27, 1999, and "New interfaces for musical expression" (NIME'01), downloadable from URL http://www.csl.sony-.co.jp person/poup/chi2000wshp/(2000), these systems all share a common drawback: they do not manage time, there is no memory of the past, and consequently the music generated is strongly correlated with musical input, but not—or poorly—with a consistent and realistic musical style.

On the other hand, music composition systems precisely aim at representing stylistic information to generate music in various styles: from the pioneering Illiac suite by Hiller and Isaacson "Experimental Music", New York, Mc.Graw-Hill, 1959, to more recent music compositions (cf. Darrell Conklin and Ian H. Witten "Multiple Viewpoint Systems for Music Prediction", JNMR, 24:1, pp.51–73).

More recently, constraint techniques have been used to produce stylistically consistent four-part Baroque music (cf. F. Pachet, P. Roy "Automatic harmonization: a survey", Constraints Journal, Kluwer, 6:1, 2001. In the field of popular music, prototypes (cf. (Biles, "Interactive GenJam; Integrating Real-Time Performance with a Genetic Algorithm", Proc. IMC 98, Ann Arbor, Mich.; Ramalho, et al, Simulating Creativity in Jazz Performance. Proc. of the National Conference in Artificial Intelligence, pp. 108–113, AAAI-94, Seattle, AAAI Press) have demonstrated the technical feasibility of simulating convincingly jazz styles by computer.

By contrast with interactive music systems, the main drawback of these approaches is that they do not allow real musical interaction: they propose fully-fledged automata that may produce impressively realistic music, but cannot be used as actual instruments.

Moreover, these approaches require explicit, symbolic information to be fed to the system, such as human input for supervised learning, underlying harmonic structure, song structure, etc.

There is also known from patent document U.S. Pat. No. 5,736,666 a music composition system that generates a real-time accompaniment to a musician by learning his or her style of music, e.g. to serve as a computerised music expert for students of compositions. The approach is based on initially receiving notes defining a first melody and harmony, determining rules that relate the harmony to the melody, and applying these rules in real time to a second melody to produce a harmony related to the latter. The harmonisation is generated in accordance with the so-called "figured base" technique. This real-time generation essentially produces the harmonic musical component to accompany a concurrent melodic phrase, and is only intended to be active all the while an input is present.

Patent document WO-A-99 46758 describes a real-time algorithmic technique for storage and retrieval of music data based on a preselection or probabilistic analysis to increase response speed. A hierarchy of information objects e.g. corresponding to features of a musical piece is established through a multi-level data structure which are each searched through simultaneously, for instance to produce a superposition of different musical styles and arrangements of musical compositions. The aim is to identify from the different levels of data structure a sequence that most closely matches an input query sequence that shall then be used to control a musical instrument in a query and answer mode. The music produced by this system is, however, based on matching process of the input sequence and the sequences in the database. Consequently, the output of the system will be an "imitation" of the input sequence, and not really a continuation as provided for by the present invention.

The invention departs from these known approaches in several fundamental ways to provide real-time interactive music generation methods and devices that are able to produce stylistically consistent music.

More particularly, the invention is capable of learning styles automatically, in an agnostic manner, and therefore does not require any symbolic information such as style, harmonic grid, tempo etc.). It can be seamlessly integrated into the playing mode of the musician, as opposed to traditional question/answer or fully automatic systems. Optional embodiments of the invention can adapt quickly and without human intervention to unexpected changes in rhythm, harmony or style.

Also, the very design of the system makes it possible to share stylistic patterns in real time and constitutes in this sense a novel form of collaborative musical instrument.

Finally, in some embodiments, it can be made easily and intimately controllable by the musician—an extension of the musical instrument—rather than as an actual intelligent and autonomous musical agent. The resulting system achieves very good performance by basically replacing, symbolic knowledge and autonomy by intimate control.

More particularly, a first object of the invention is to provide a method of automatically generating music from learnt sequences of music data acquired during a learning phase, characterised in that it generates music as a real time continuation of an input sequence of music data, the method having a continuation phase comprising the steps of:

detecting the occurrence of an end of a current input sequence of music data, and starting to generate the continuation upon the detected occurrence of an end of a current input sequence of music data.

Thus, the invention makes it possible to generate improvised continuations on the fly starting from where the current input sequence happened to have been interrupted.

Preferably, the method also comprises the steps of determining a data rate of the current input sequence of music data and of timing the start of the continuation substantially in phase with the determined data rate such that the transition from an end of the current input sequence to the starting of the continuation is substantially seamless.

In the embodiment, this data rate—which typically corresponds to the tempo or rhythm of the music—is determined and updated dynamically, e.g. by taking a sliding average of intervals between recent data inputs.

Preferably, the start portion of said generated continuation is selected from a learnt input sequence which contains the terminal portion of the current input sequence up to the detected end and which has an identified continuation therefor, when such a learnt sequence is found to exist, such that a concatenation of the terminal portion and the start portion forms a data sequence contained in the learnt sequence.

In the preferred embodiment, the learning phase comprises establishing a data base of music patterns which is mapped by a tree structure having at least one prefix tree, the tree being constructed by the steps of:

identifying sequences of music data elements from music data elements received at an input, producing a tree corresponding to at least one prefix of that sequence, entering the continuation element for that prefix as an index associated to at least one node, and preferably each node, of the prefix tree.

As more sequences are learnt, there can be more than one continuation element at a node. More generally, the continuation element(s) are identified through a continuation list associated to a node.

The prefix tree can be constructed by parsing the prefix in reverse order relative to the time order of the music sequence, such that the latest music data item in the prefix is placed at the point of access (in other words the entrance end) to the tree—the root node—when the tree is consulted.

There can further be provided the steps of assigning to at least one node of the prefix tree structure a label that corresponds to a reduction function of the music data for that node.

Same input sequences can be used construct a plurality of different tree structures, each tree structure corresponding to a specific form of reduction function. The label assigned to a prefix tree can be a freely selectable reduction function. In the embodiment, for instance, a pitch region is treated as a selectable reduction function.

During the learning phase the step of establishing the data base of music patterns can comprise a step of creating an additional entry into the data base for at least one transposition of a given input sequence to enable learning of the pattern in multiple tonalities.

The continuation phase preferably comprises the step of walking through the tree structure along a path yielding all continuations of a given input sequence to be completed, to produce one or more sequences that are locally maximally consistent and which have substantially the same Markovian distributions.

The method preferably comprises, during the continuation phase, the step of identifying which tree structure among the plurality of tree structures provides an optimal continuation for a given continuation sequence, and of using that identified tree structure to determine said continuation sequence.

Preferably, the method comprises the steps, during the continuation phase, of:

searching for matches between the music data items at successive nodes of a tree and corresponding music data items of the sequence to be continued, the latter being considered in reverse time order, starting with the last data item of the sequence to be continued, reading data at the node of a prefix tree where the last successful match has been found in the search step, that data indicating the music data element that follows the prefix formed by the matching data element(s) found in the searching step, for at least one learnt sequence of the database, and selecting a continuation music data element from at least one music data element indicated by that data.

In the embodiment, the data in question is provided by a continuation list associated to the last matching node, that list being the set of one or more indexes each designating the music data item stored in the database and which the follows the matching prefix(es).

Advantageously, the method provides a step of selecting an optimal continuation from possible candidate selections on the basis of the candidate continuation having the longest string of music data items and/or the nature of its associated reduction function.

Advantageously, during the continuation phase, in a case of inexact string matching between the contents of the music patterns in the data base and an input sequence to be continued on the basis of a first reduction function for the music data elements, the continuation can be searched on the basis of a second reduction function which offers more tolerance than said first reduction function.

The second reduction function is selected according to a hierarchy of possible second reduction functions taken from the following list, given in the order which they are considered in case of the inexact string matching:

i) pitch and duration and velocity, ii) small pitch region and velocity, iii) small pitch regions, iv) large pitch regions.

The method can also comprise, during the learning phase, the steps of:

detecting in a received sequence of music data the presence of polyphony, determining notes that appear together within predetermined limits, and aggregating the notes.

During the learning phase, the method can further comprise the steps:

detecting in a received sequence of music data the presence of notes that are overlapping in time, determining the period of overlap of the notes, identifying the notes as legato notes if the period of overlap is less than a predetermined threshold, and recording the identified legato notes as separated notes.

During the continuation, the method can further comprise the step of restoring the original overlap of notes in the notes that were recorded as separated as legato notes.

During said continuation phase, the method can further comprise providing a management of temporal characteristics of musical events to produce a rhythm effect according to at least one of the following modes:

i) a natural rhythm mode, in which the generated sequence is produced with the rhythm of that sequence when acquired in said learning phase, ii) a linear rhythm mode, in which the generated sequence is produced in streams of a predetermined number of notes, with a fixed duration and said notes concatenated, iii) an input rhythm mode, in which the rhythm of the generated sequence is the rhythm of the sequence to be continued, possibly with warping to accommodate for differences in duration, iv) a fixed metrical structure mode, which the input sequences are segrnented according to a fixed metrical structure e.g. from a sequencer, and optionally with a determined tempo.

During the continuation phase, the method can farther comprise providing a management of temporal characteristics of musical events to produce a rhythm effect according to a fixed metrical structure mode, which the input sequences are segmented according to a fixed metrical structure e.g. from a sequencer, and optionally with a determined tempo.

Advantageously, during a continuation phase, a music sequence being produced can be caused to be influenced by concurrent external music data entered, through the steps of:

detecting a characteristic of said entered music data, such as harmonic information, velocity, etc., and selecting candidate continuations by their degree of closeness to the detected characteristic.

The concurrent external music data can be produced from a source, e.g. a musical instrument, different from the source, e.g. another musical instrument, producing said current music data.

The music patterns forming the data base can originate from a source, e.g. music files, different from the source producing the current music data, e.g. a musical instrument.

According to a second aspect, the invention relates to a device for automatically generating music from learnt sequences of music data acquired during a learning phase, characterised in that it generates music as a real time continuation of an input sequence of music data, the device comprising:

means for detecting the occurrence of an end of a current input sequence of music data, and means for starting to generate the continuation at the detected occurrence in real time of the current music data.

The device can be made operative during a continuation phase to allow a music sequence being produced to be influenced by concurrent external music data, by comprising:

input means for receiving the external music data and detecting a characteristic thereof, such as harmonic information, velocity, etc., and means for selecting candidate continuations by their degree of closeness to the detected characteristic.

The device can be configured to perform the method according to any one or group of characteristics defined above in the context of the first aspect, it being clear that characteristics defined in terms of process steps can be implemented by corresponding means mutatis mutandis.

According to a third aspect, the invention relates to a music continuation system, characterised in that it comprises:

a device according to the second aspect, a first source of music data operatively connected to supply data to the data base, and a second source of music data producing the current music data, e.g. a musical instrument.

The first source of audio data can be one of:

i) music file data, and ii) an output from a musical instrument; and the second source of audio data can a musical instrument.

According to a fourth aspect, the invention relates to a system comprising:

at least first and second devices according to the second aspect, a first musical instrument and a second musical instrument different from the first musical instrument, wherein the first musical instrument is operatively connected as a source of data for the data base of music patterns of the first device and as a source of current music data for the second device, whereby the second device generates a continuation with a sound of the first musical instrument referring to a data base produced from the second instrument, and the second musical instrument is operatively connected as a source of data for the data base of music patterns of the second device and as a source of current music data for the first device, whereby the first device generates a continuation with a sound of said second musical instrument referring to a data base produced from the first instrument.

According to a fifth aspect, the invention relates to a computer program product directly loadable into the memory, e.g. an internal memory, of a digital computer, comprising software code portions for performing the steps of the method according to appended claim 1, and optionally any one of its dependent claims, when the product is run on a computer.

It can take the form of a computer program product stored on a computer-usable medium, comprising computer readable program means for:

detecting the occurrence of an end of a current input sequence of music data, and starting to generate the continuation upon the detected occurrence of an end of a current input sequence of music data, in the context of the method according to appended claim 1, and optionally for executing any other characteristic(s) of its dependent claims.

The invention and its advantages shall become more apparent from reading the following description of the preferred embodiments, given purely as non-limiting examples, with reference to the appended drawings in which:

FIG. 1 is a general block diagram showing the functional elements of an improvisation system in accordance with a preferred embodiment of the invention, FIG. 2 is a diagram showing the basic flow of information to and from the system of FIG. 1;

FIGS. 3*a* to 3*c* are diagrams of an example showing different stages of the construction of a prefix tree structure by the learning module of the system shown in FIG. 1;

Figure 1:
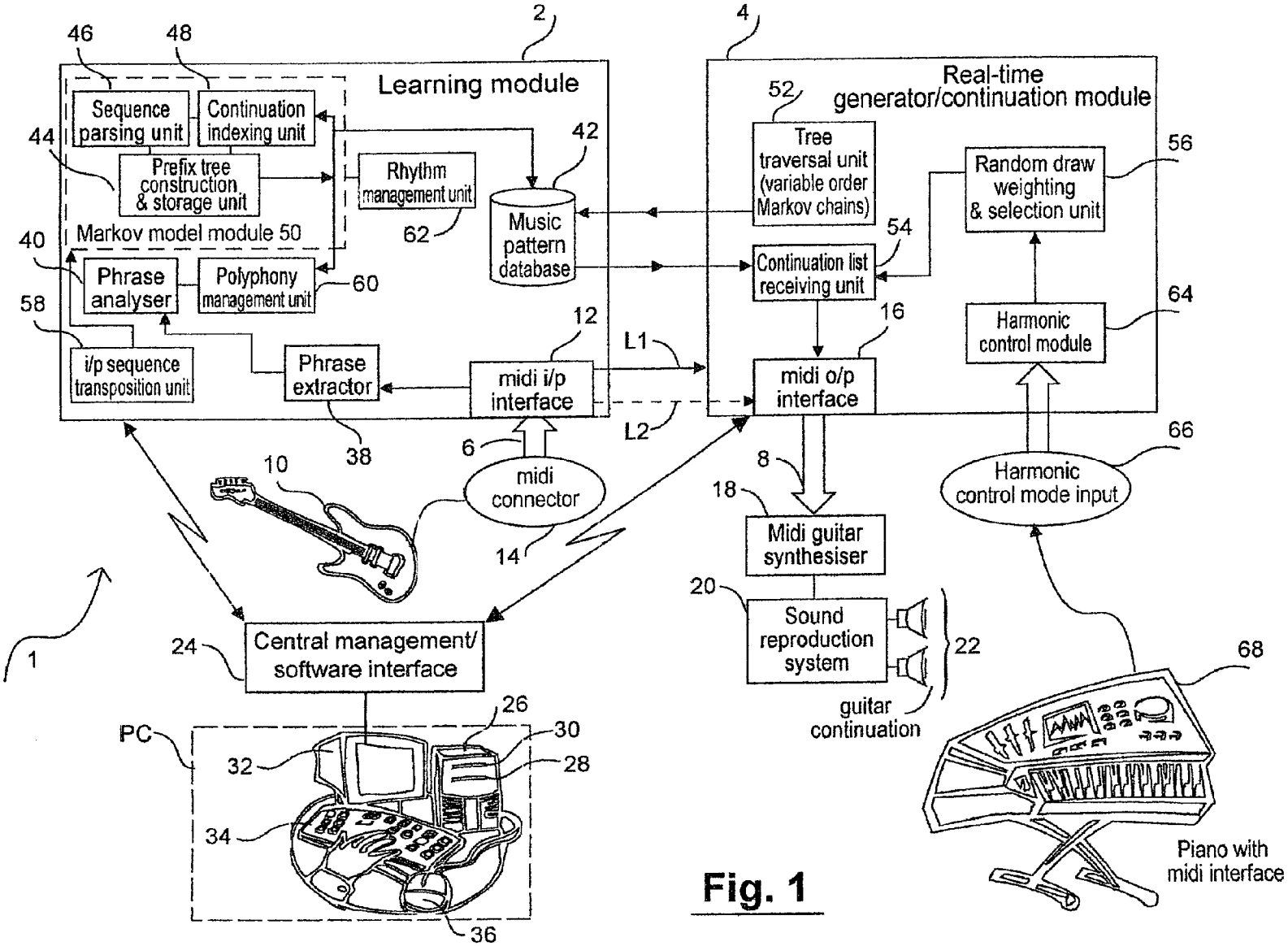

As shown in FIG. 1, a music continuation system 1 according to a preferred embodiment of the invention is based on a combination of two modules: a learning module 2 and a generator/continuation module 4, both working in real time. The input 6 and the output 8 of the system are streams of Midi information. The system 1 is able to analyse and produce pitch, amplitude, polyphony, metrical structure and rhythm information (onsets and duration).

The system accommodates several playing modes; it can adopt an arbitrary role and cooperate with any number of musicians.

Figure 2:
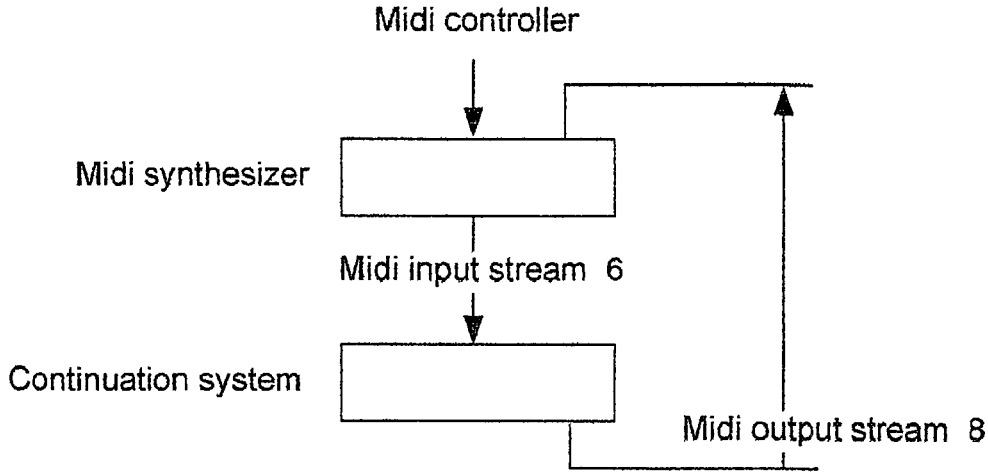

The Midi information flow in the standard playing mode is shown by the diagram of FIG. 2.

Returning to FIG. 1, the system 1 receives input from one musician, whose musical instrument, e.g. an electric guitar 10, has a Midi-compatible output or interface module connected to a Midi input interface 12 of the learning module 2 via a Midi connector box 14.

The output 8 of the system 1 is taken from a Midi output interface 16 to a Midi synthesiser 18 (e.g. a guitar synthesiser) or the Midi input of another musical instrument, and then to a sound reproduction system 20. The latter plays through loudspeakers 22 either the audio output of the system 1 or the direct output from the instrument 10, depending whether the system or the instrument is playing.

The learning module 2 and the generator/continuation module 4 are under the overall control of a central management and software interface unit 24 for the system 1. This unit is functionally integrated with a personal computer (PC) comprising a main processing unit (base station) 26 equipped with a mother board, memory, support boards, CDrom and/or DVDrom drive 28, a diskette drive 30, as well as a hard disk, drivers and interfaces. The software interface 24 is user accessible via the PC's monitor 32, keyboard 34 and mouse 36. Optionally, further control inputs to the system 1 can be accessed from pedal switches and control buttons on the Midi connector box 14, or Midi gloves.

Although the described embodiment is based on a Midi system linked to an arbitrary Midi controller using a Midi keyboard and guitar, it is clear that it is also applicable to any style and Midi controller. It can also be implemented for processing raw audio signals, the concepts of the invention being in a large part independent of the nature of the information managed.

In the embodiment, music is considered as temporal sequences of Midi events. The focus is on note events, but the generalisation to other Midi events (in particular information from pitch-bend and Midi controllers) is straightforward. The information concerning notes that is presented is: pitch (defined by an integer value between 0 and 127), velocity/amplitude (also defined by an integer between 0 and 127), and temporal information on start and duration times, expressed as long integers with a precision of 1 millisecond, which is ample for musical performance.

The invention also includes a provision for managing so-called continuous Midi controllers (e.g. pitch bend, aftertouch). Input controllers provide a stream of specific information which is recorded together with the input streams during the learning phase. At the generation phase, when a note item is produced by the system, the corresponding continuous controller information is retrieved from these recorded streams and attached to the output.

Technically, the described embodiment uses the "Midishare" Midi operating system as described e.g. in the paper by Y. Orlarey and H. Lequay "MidiShare: a real time multitask software module for Midi applications", in Proceedings of the International Computer Music Conference, Computer Music Association, San Francisco, pp.234–237, 1989. The model is implemented with Java 1.2 language on a Pentium III PC. However, other operating systems can envisaged, for instance any Midi scheduler or the like could serve as a satisfactory platform.

In the standard situation, the system 1 acts as a "sequence continuator": the note stream of the musician's instrument 10 is systematically segmented into phrases by a phrase extractor 38, using a temporal threshold (typically about 250 milliseconds). In this embodiment, the notes (e.g. pitch and duration) constitute respective items of music data. In the more general case, the music data can take on any form recognised by a music interface, such as arbitrary Midi data: pitch, duration, but also velocity, and pitch region, etc.

A sequence of items of music data is thus understood as group of one or more items of music data received at the midi input interface 12, the sequence typically forming a musical phrase or a part of it. The temporal threshold ensures that the end of a sequence is identified in terms of a lapse of time occurring after a data item, the idea being that the time interval between the last music data item of a sequence and the first data music data item of the next sequence is greater than the interval between two successive music data items within a same sequence. The approach for identifying this condition automatically is identical to that used for detecting an end of sequence in view of starting the improvised continuation in the continuation phase (cf. section "real time generation—thread architecture" infra) and shall not be repeated here for conciseness.

Each phrase resulting from that segmentation is sent asynchronously from the phrase extractor 38 to a phrase analyser 40, which builds up a model of recurring patterns for storing in a database 42, as shall be explained further. In reaction to the played phrase, the system generates a new phrase, which is built as a continuation on the fly of the input phrase according to a database of patterns already learnt.

The learning module 2 systematically learns all melodic phrases played by the musician to build progressively a database of recurring patterns 42 detected in the input sequences produced by the phrase analyser 40 using an adapted Markov chain technique. To this end, the learning module 2 further comprises:

a prefix tree construction unit 44;

a sequence parsing unit 46; and a continuation indexing unit 48.

These three units 44, 46 and 48 together constitute a Markov model module 50 for the system 1. The breakdown of the Markov chain management function into these units 44–48 is mainly for didactic purposes, it being clear that a practical implementation would typically use a global algorithmic structure to produce the required Markov model running on the PC 26.

Other units of the learning module, which shall be described further, are:

an input sequence transposition unit 58, a polyphony management unit 60, and a rhythm management unit 62.

It has long been known that Markov chains allow to represent faithfully musical patterns of all sorts, in particular based on pitch and temporal information. One major interest of Markov-based models is that they allow to naturally generate new musical material in the style learned. The most spectacular application to music is probably the compositions disclosed by D. Conklin and I. Witten in "Multiple viewpoint systems for music prediction", JNMR, 24:1, pp.51–73, whose system is able to represent faithfully musical styles. However, the ad hoc scheme used in that application is not easily reproducible and extensible.

Recently, some variations of the basic Markov models have been introduced to improve the efficiency of the learning methods, as well as the accuracy of the music generated, as disclosed in G. Assayag, S. Dubnov and O. Delerue "Guessing the composer's mind: applying universal prediction to musical style", Proc. ICMC 99, Beijing, China, ICMA, San-Francisco, 1999 and Trivino-Rodrigues. 1999 (J. L. Triviño-Rodriguez; R. Morales-Bueno, "Using Multiattribute Prediction Suffix Graphs to Predict and Generate Music", *CMJ* 25 (3) pp. 62–79 , 2001.). In all these cases, the main idea is to represent in some way the local patterns found in the learnt corpus, using probabilistic schemes. New sequences are then generated using these probabilities, and these sequences will contain, by definition, the patterns identified in the learnt corpus. The Applicant of the present invention determined that: 1) Markov chain models (and their extensions, notably for variable-length) do allow to represent efficiently musical patterns, but 2) their generative power is limited due to the absence of long-term information. In another words, these models can fool the listener on a short scale, but not for complete pieces.

Using Markov models for interaction purposes allow to benefit from 1) and avoid the drawback of 2). The responsibility for organizing the piece, deciding its structure, etc. are left to the musician. The system only "fills in the gaps", and therefore the power of Markov chain can be exploited fully.

The main issues involved in building effective and realistic models of musical styles are:

efficiency and the ability to perform the learning in real time, a realistic management of continuity, the handling of specifically musical issues such as rhythm and polyphony.

Each of these issues are discussed on the following sections.

1. Learning in Real Time

The learning module 2 systematically learns all phrases played by the musician, and builds progressively the database of patterns 42 detected in the input sequences by the phrase analyser 40. The embodiment is based on an indexing scheme (unit 48) which represents all the sub-sequences found in the corpus, in such a way that the computation of continuations is: 1) complete and 2) as efficient as possible. This learning scheme, constitutes an efficient implementation of a complete variable-order Markov model of input sequences.

The technique used consists in constructing a prefix tree T (unit 44) by a simple, linear analysis of each input sequence (sequence parsing unit 46).

Each item of music data received is memorised in the music pattern database 42 according to indexing scheme whereby its rank can be identified. The rank indicates the position of the item of music data in the chronological order of music it represents, starting from the first received. The rank evolves continually (i.e. without reset after the end of each phrase or sequence identified at the level of the phrase extractor 38). Thus, if the last item of music data at an identified sequence is of rank r, then the first item of music data of the following sequence is of rank r+1, where r is an integer. This indexing can be achieved naturally using standard sequential storage techniques and addressing techniques. In this way, the tree structure T (FIGS. 3*a*–3*c*) can effectively map the contents of the music pattern database 42 by their indexes, which typically take the form of integers. In the embodiment, an the $r^{th}$ music data item received (i.e. having rank r) simply has the index r, designated {r} in the notation used.

Each time a sequence is input to the system, it is parsed by unit 46 in the reverse order relative to the chronological order of the music represented giving rise to the sequence. Assuming the normal case where the sequence is received in the chronological order of the corresponding music and is mapped against a time axis evolving from left to right, the parsing can be defined as being from right to left with respect to that time axis. New prefixes encountered are systematically added to the tree. The continuation indexing unit 48 labels each node of the tree is labelled by a reduction function of the corresponding element of the input sequence. In the simplest case, the reduction function can be the pitch of the corresponding note. The next section describes more advanced reduction functions, and stresses on the their role in the learning process. To each tree node is also attached a list of continuations encountered in the corpus. These continuations are represented by the above-defined index of the continuation item in the input sequence. Such an indexing scheme makes it possible to avoid duplicating data, and allows to manipulate just the indexes. When a new continuation is found for a given node, the continuation indexing unit 48 simply adds the corresponding index to the node's continuation list (shown in the FIGS. 3*a* to 3*c* between curly brackets {}).

For instance, suppose the first detected input sequence is formed of music data (e.g. notes) {A B C D}, i.e. there is detected pause after music data item D sufficiently long to signify the end of the sequence (e.g. musical phrase). These items shall then be stored and indexed with the following indexes {}: A=>{1}, B=>{2}, C=>{3} and D =>{4}.

The tree structure T is in this case constructed by considering prefixes of that sequence, a prefix being a sub-sequence containing the first part of the sequence without changing the order or removing data items. The chronological order is kept at this stage. Thus, the sequence {A B C D} has a first prefix formed by the sub-sequence of the first three data items {A B C}, a second prefix formed by the sub-sequence of the first two data items {A B}, and finally a third prefix formed by the sub-sequence of the first data item {A}.

Once the prefixes for the sequence are established, each is then parsed in the reverse (right to left order) to construct a respective prefix tree T1, T2 and T3 of the structure. The overall tree structure T. The right to left parsing means that data elements of a prefix tree for a given learnt sequence are positioned so that when that tree is walked through to read its contents in the continuation mode, these elements will be encountered sequentially in an order starting from the last received element of that learnt sequence. In the example, that last received element is placed at the root node (topmost node of the prefix trees in FIGS. 3*a*–3*c*), the root node being by convention the starting point for reading prefix trees in the continuation mode. As explained below, this reverse ordering is advantageous in that it allows to compare sequences to be continued against the trees by considering those sequences also in reverse sequential order, i.e. starting from the element where the sequence to be continued ends. This starting point at the end of the sequence ensures that the longest matching subsequences in the tree structure can be found systematically, as explained in more detail in the section covering on the generation of continuations.

Thus, returning to the example, in the first iteration, the first prefix {A B C} of sequence {A B C D} is parsed from right to left, whereupon it becomes {C B A}. These items constitute respective nodes of the first tree T1 shown at the left part of the tree structure shown in FIG. 3*b*. The first parsed item C is placed at the top of the tree, which constitutes the "root node", its descendants being placed at respective potential nodes going towards the bottom. Thus, the next item parsed, B, being the "son" of C, is placed at the next node down of tree T1, and the last item parsed, C, is at the bottom of that tree.

To each of the three respective nodes is attributed the index that identifies the music data item immediately after the first prefix in the normal order. That next item being the fourth recorded music data item, each node of tree T1 is thus assigned the index {4}. The purpose of assigning that index {4} to each node of tree T1 can be understood as follows: tree T1 will be walked down in the continuation phase if the sequence to the continued happens to end with music data element C, that tree having the root node C. The tree will be walked down to the extend there is match found along each of its nodes. If the last three music data items of the sequence to be continued happened to coincide with the parsing order of tree T1, i.e. the sequence ends with A B C, then the tree shall be walked down to its end (bottom) and the bottom-most element shall indicate by its associated index {4} that data element D has the prefix A B C in the learnt corpus of the database. But the sequence to be continued could also end with X B C (with X≠A), in which case the walk through would end at the second node down starting from the root node, containing data element B. It is then the index {4} associated to that data element serves which indicates the fact that data element D has the prefix B C, and could also thus also constitute a possible continuation. Likewise, it is the index {4} associated to data element C at the root node which indicates that the short sub-sequence C D has been encountered in the learning phase and that D can thus be considered as a candidate continuation. It will be noted that a remarkable property of using prefix trees in the present context is that the continuation music data items they yield do not occupy a tree node or are not represented as such, but appear as associated data (here in the form of numerical indexes).Then the process starts again for the second prefix {A B} of the first sequence to build the second tree T2 (middle tree of FIG. 3*a*) using the same approach as for the first prefix. In this case, the parsing right to left parsing produces B as the first item to placed at the top of tree T2, item A being at the node immediately below. As the next music data item after the second prefix is the third recorded music data item, each node of tree T2 is assigned the index {3}.

Figure 3A:
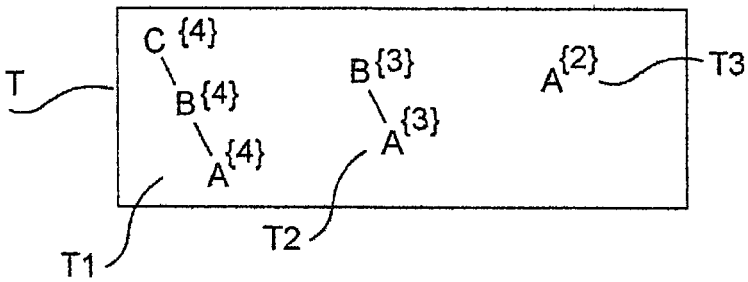

Finally, the third prefix {A} is parsed and produces the tree T3 (right hand tree of FIG. 3*a*). As the next music data item after the third prefix is the second recorded music data item, the single node of tree T3 is assigned the index {2}.

Nodes are created only once the first time they are needed, with empty continuation lists. The tree grows as new sequences are parsed, initially very quickly, then more slowly as patterns encountered repeat.

For parsing the next (second) identified sequence, the same mechanism is used to parse again each of its prefixes from right to left.

Figure 3B:
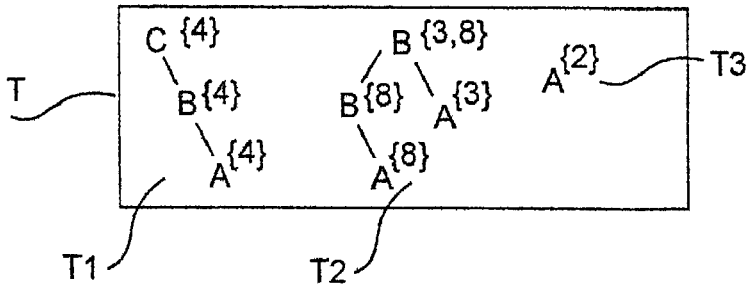
Figure 3C:
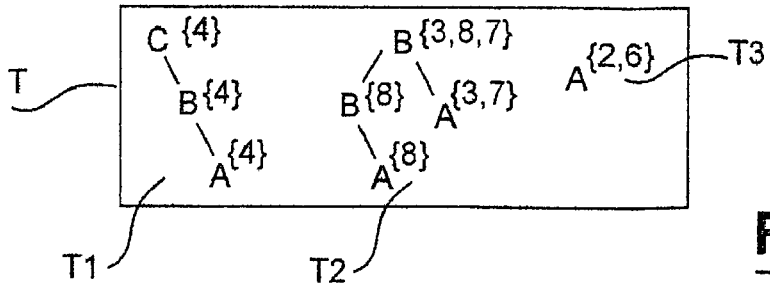

In the example of FIGS. 3*b* and 3*c*, the second identified sequence happens to be {A B B C}, with its music data items identifiable by chronological order in the database with the following indexes: A=>{5}, B=>{6}, B=>{7} and C=>{8}.

The parsing process for that second sequence produces the updated tree structure shown in FIG. 3*b*, where the new nodes and continuations are added.

Specifically, the second sequence has the following prefixes:

first prefix {A B B},
second prefix {A B}, and
third prefix {A}.

Right to left parsing of the first prefix gives the sequence B B A. Now, as there already exists a tree starting with music data item B, namely tree T2, there is no need to start a new tree. Instead, the tree construction starts from the root (top) node containing data item B of tree T2 and branches from there with the successive descendants B and A. Because next item after that prefix is the eighth of the total number of received data items, each node containing an item of that prefix has the index {8} assigned to it, for the reasons explained above. This is the case for the nodes B and A branching from top node B of tree T2, and also for that top node itself, the latter then having both index 3 from the first sequence and index 8 for the present parsing, symbolised by {3,8}.

For the second prefix, the right to left parsing gives the sequence B A. This sequence happens to correspond exactly to the second tree T2 produced for the first sequence. This tree T2 can therefore be used again as such for that second prefix, simply by adding the required index for the latter, which is in this case {7}, the next music data B after that prefix being the seventh of the total number received. Using the specified notation, node B and node A of the second tree T2 then have the indexes {3, 8, 7} and {3, 7} respectively.

Finally, for the third prefix, its single member A similarly corresponds exactly to the third tree T3 of FIG. 3*a*. This tree is then used for that third prefix simply by adding the index {6} to the latter, yielding {2, 6} in the specified notation, as the music data item considered following member A is the sixth of the total number received.

The same approach is used for each new identified sequence received. In the general case, each identified sequence received is broken down to all its possible prefixes, there being P-1 possible prefixes for a sequence of P items according to the definition given above. Each of the P-1 prefixes will then undergo a right to left parsing as explained above with the construction of either a respective new tree or a branching off at some point from an existing tree, or the use of an existing tree.

As explained below, this graph has the property that retrieving continuations for any sub-sequence is extremely fast, and requires a simple walkthrough the input sequence.

Generation of Continuations

The second module 4 of the system 1, the real time continuation mechanism, generates music in reaction to an input sequence 6 inputted at the learning module 2. The generation is performed using a traversal of the trees built from input sequences executed by a tree traversal unit 52. The main property of this generation is that it produces sequences which are locally maximally consistent, and which have the same Markovian distributions.

The generation is performed by producing items one by one, and at each iteration considering the longest possible sub-sequence that matches a sub-sequence of the learnt corpus in the database 42. Once a continuation is generated, the process is repeated with the input sequence augmented by the continuation. Such a tiling mechanism makes the real-time generation possible, as described in the next sections. This process, referred to as variable-order Markov chains is the following. Suppose an input sequence such as:

{A B}

In the search for all continuations of {A B}, the tree traversal unit 52, begins by looking for a root node of the tree structure T corresponding to the last element B of the input sequence {A B}. A walk down this tree is then conducted, starting from the root node, checking at each node down if the corresponding data element of that node matches next data element back of the input sequence until either the input sequence is completed, or the match is not found. When the walkthrough is finished, the procedure simply returns the set of one or more indexes identifying each data element of the database 42 for which the path walked down constitutes a prefix, i.e. identifying each data element that is a continuation element of the input sequence. The one or more indexes in question is thus referred to as a continuation list.. In the present example, the procedure would find a continuation list for the whole input sequence {A B} given by the second tree T2 (cf. FIG. 3*c*), giving:

Continuation_List ({A B})={3, 7},

Where {3, 7} is simply the list of indexes contained at the end of the tree T2, i.e. those against node A.

Theses indexes correspond to the third and seventh stored music data items of the database, namely C and B respectively, symbolised by {C, B}. The candidate continuations C and B are thus extracted from the database by reference to their respective index and entered as respective items in a continuation list receiving unit 54.

It can be seen that, for a received sequence, a continuation exists in the learnt corpus stored when the database 42 contains at least one chronologically ordered sequence of music data elements that is the concatenation of: the sub-sequence comprising the last element(s) of the sequence to be continued and the sub-sequence comprising the first element(s) of the generated continuation. This is verified in the example by the fact that the sub-sequences {A B C} and {A B B} have indeed been encountered in the learning phase.

When the continuation list contains more than one continuation data element, a continuation is then chosen by a random draw among these candidate items of the continuation list produced by a random draw and weighting module 56. If B is drawn, for instance, the procedure then starts again with the new sequence:

{A B B}

The retrieving process is then repeated to find the appropriate continuation list, given by taking that new sequence in reverse order and going down the second tree T2, branching at the root node B (FIG. 3*c*), giving:

Continuation_List ({A B B})={8}.

The only possible continuation (index 8 corresponds to item C, the eighth stored music data item) is chosen, and returns {A B B C}.

No continuation is found for the whole sequence {A B B C}, but there are obtained continuations for the longest possible sub-sequence, that is here:

Continuation_List ({B C })={4},

Given by following the reversed order sequence C B along the first two node of tree T1, yielding continuation list {4}. Index {4} then yields D as the next continuation item, D being the fourth stored music data item.

This sequence {A B B C D} is then supplied from the continuation list receiving unit 54 to the Midi output interface 16, and from there to the external units 18–22 as Midi data for playing the continuation.

The generation process is continued, but at this point, the, example gives no continuation for {A B B C D}, and neither for any sub-sequence ending by D (indeed, D has always been a terminal item in the learnt corpus for the example considered).

The above example illustrates the advantages of the indexed tree structure produced in the learning phase and the corresponding walk through starting from the most recently received data item in the continuation phase.

In particular, the fact that the parsing is effected in reverse order (relative to the chronological order) order during the learning phase makes it very simple to identify the longest possible sub-sequence(s) stored in the database 42 which match(es) the terminal portion (terminal sub-sequence) of the sequence to be continued. Indeed, the walk through in the continuation phase can be performed by the following algorithmic loop:

For a sequence of music data elements to be continued: E1, E2, E3, . . . Ek−2, Ek−1, Ek, where Ek is the $k^{th}$ and last element of that sequence:

Step i) set i=k;

Step ii) look for tree(s) whose root node (topmost element) has the element Ei (matching root node);

Step iii) retain tree(s) with matching root node;

Step iv) set i=i−1; consider the next node down from root node of retained tree(s);

Step v) determine whether node considered has the element Ei (matching node);

Step vi) if no matching node found, do the following: read the continuation list at the last matching node, extract the corresponding data item(s) from the database and load into the continuation list receiving unit 54;

Else go to back step iv).

When the search ends at step vi), the continuation list receiving unit 54 shall have a set a continuations to choose from. The selection of which candidate to choose if several exist is established by the random draw, weighting and selection unit 56. Once that selection is made, the selected element (designated Ek+1) is sent to the midi output 16 to constitute the first item of real time improvised continuation.

It can be appreciated that the search will systematically seek out in the database the sub-sequence that matches the longest possible terminal portion of the sequence to be continued: the "last matching node" at step vi) is simply the node furthest removed from the root node in a line of successfully matching nodes. The above results from the fact that in the learning phase, the trees are constructed so that their starting point for a future search, i.e. their root node, is made to be the last item of the learnt sequence, by virtue of the right to left parsing. This allows a direct sequential comparison with the terminal portion of the sequence to be continued when the latter is likewise considered in reverse order.

To establish the next element Ek+2 of the continuation, the above algorithm is repeated, but with the previously considered sequence E1, E2, . . . Ek now ending with the new continuation element Ek+1, giving the sequence E1, E2, . . . , Ek, Ek+1.

Thus, the algorithm will this time search for all trees having at their root node the element Ek+1, and then among those, the ones having Ek as their immediate descendant, etc. until the end(s) of the longest sequence(s) of matching nodes is/are found. The data element(s) designated by the continuation list associated to the/each last matching node is then retrieved from the database 42 and entered into the continuation list receiving unit 54, of which one is selected by unit 56 to constitute the next music data item of continuation Ek+2.

The above procedure is repeated cyclically, each time giving rise to one new continuation item of music data.

If, as can also be envisaged in a variant embodiment, the trees had instead been constructed by parsing in the naturally occurring order of received data items during the learning phase, i.e. so that the root node is the first data item of a received data sequence, then the starting point for the search to identify the matching nodes in the trees during the walk through in the continuation phase is not the last element Ek of the sequence to be continued, but an arbitrarily chosen starting point before the end of the sequence to be continued. If no match is found from that starting point, a shorter sequence is selected instead, e.g. by selecting as starting point the element one position closer to the end, etc. until a matching sequence is found.

However, this variant suffers from the problem of determining how far back in the sequence to be continued should that starting point be: if the starting point for the search is too far back (over-optimistic case), implying a search for a long matching sequence, then the risk of failure would be too great to be justified; if the starting point is too close to the end (over-pessimistic case), then there is the risk of missed opportunities to find longer and better matching sub-sequences in the database 42.

A reasonable balance between these two extremes can be found experimentally for determining an appropriate starting point in an embodiment where a reverse parsing is not implemented in the learning phase.

Various criteria can be applied in the search. For instance, candidate data items can be taken not necessarily from the longest found sub-sequence along a tree, but on the basis that they belong to a matching sub-sequence of sufficient length (determined by an input parameter).

Also, when the learning phase involves producing several tree structures in parallel for the same set of received input data sequences, the tree structures differing by the reduction function applied to the received data items, then the search can be conducted on all or a subset of that plurality of trees. This simply involves walking through each of the tree structures considered in the same manner as explained above for a given sequence to be continued.

Other criteria can then be invoked to select and weight candidate data items. For instance, a hierarchy of preferences can be accorded to the different tree structures by appropriate weighting at the level of unit 56.

When no continuation is found for the input sequence, a node is chosen at random through unit 56. The next section describes another, improved, mechanism for handling such cases of discontinuity.

Note that at each iteration, the continuation is chosen by a random draw, weighted by the probabilities of each possible continuation. The probability of each continuation is directly given by drawing an item with an equal probability distribution, since repeating items are repeated in the continuation list. More particularly, for a continuation x, its probability is:

Markov_Prob(x)=nb of occurrences of x in L, where L is the continuation list.

Since the continuations are in fact indexes to the original sequences, the generation can use any information from the original sequence which is not necessarily present in the reduction function (e.g. velocity, rhythm, Midi controllers, etc.): the reduction function is only used to build the tree structure, and not for the generation per se.

Reduction Functions

As discussed in the preceding section, the input sequences in the embodiment are not learnt from raw data. A Midi sequence has many parameters, all of which are not necessarily interesting to learn. For instance, a note has attributes such as pitch, velocity, duration, start time. A chord has attributes such as the pitch list, possibly its root key, etc. Accordingly, the system allows the user to choose explicitly from a library of predefined reduction functions. The simplest function is the pitch. A more refined function is the combination of pitch and duration.

Trivino-Rodrigues J. L. Triviño-Rodriguez; R. Morales-Bueno, "Using Multiattribute Prediction Suffix Graphs to Predict and Generate Music", *CMJ* 25 (3) pp. 62–79, 2001.) introduced the idea of multi-attribute Markov models for learning musical data, and made the case that handling all attributes requires in principle a Cartesian product of attribute domains, leading to an exponential growth of the tree structures. The model they propose allows to avoid building the Cartesian product, but does not take into account any form of imprecision in input data.

Conklin Conklin, D. and Witten, Ian H. Multiple Viewpoint Systems for Music Prediction, JNMR, 24:1, 51–73, 1995) propose different reduction functions (called viewpoints) for representing music.

After conducting experiments with real music, the Applicant developed and implemented such a library of reduction functions, including the ones mentioned in these works, as well as functions specially designed to take into account realistic Jazz styles. However, they can of course be used for any form of music. One of these reduction functions developed by the Applicant is the "PitchRegion" function, which is a simplification of pitch. Instead of considering explicitly pitches, this function reduces pitches in regions, practically by considering only pitch/region_size.

The choice of reduction function to use is established in the learning phase, by appropriate labelling of the tree structures as explained above. The incoming music data at the learning phase can be reduced to arbitrarily chosen reduction functions by classical techniques. A respective tree is constructed for each reduction function applied to the incoming music data, whereupon a same sequence of incoming music data can yield several different tree structures each having a specific reduction function. These trees can be selected at will according to selected criteria during the continuation phase.

Hierarchical Graphs

One issue in dealing with Markov models is the management of imprecision. By definition, Markov models deal with perfect strings, and there is no provision for handling imprecision. In the example considered, the String {A B C X} has no continuation, simply because symbol X has no continuation. In the approaches proposed so far, such a case would trigger the drawing of a random node, thereby breaking somehow the continuity of the generated sequence.

The treatment of inexact string matching in a Markovian context is addressed typically by Hidden Markov Models. In this framework, the state of the Markov model is not simply the items of input sequences, as other, hidden states are inferred, precisely to represent state regions, and eventually cope with inexact string inputs. However, Hidden Markov Models are much more complex than Markov models, and are costly in terms of processing power, especially in the generation phase. More importantly, the determination of the hidden states is not controllable, and may be an issue in a practical context.

Figure 4:
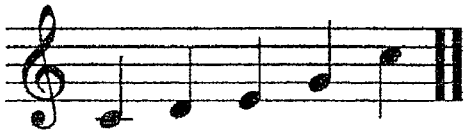
FIG. 4 is a musical score of an example of an arpeggio learnt by the system of FIG. 1.

The preferred embodiment uses another approach, based on a simple remark. Suppose a model trained to learn the arpeggio shown in FIG. 4.

Suppose that the reduction function is as precise as possible, say in terms of pitch, velocity and duration.

Figure 5:
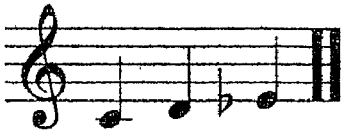
FIG. 5 is a musical score of an example of an input sequence to the system of FIG. 1 that does not match exactly with a learnt corpus of the latter.

Suppose now that the input sequence to continue is the one shown in FIG. 5.

It is clear that any Markov model will consider that there is no continuation for this sequence, simply because there is no continuation for Eb (E flat). The models proposed so far would then draw a new note at random, and actually start a new sequence.

However, it is also clear intuitively that a better solution in such a case is to shift the viewpoint. The idea is to consider a less refined reduction function, i.e. a reduction function which offers more latitude. In this case, pitch regions (denoted PR) of three notes instead of pitches can be considered, for instance.

The learnt sequence is then reduced to:

{PR1 PR1 PR2 PR3 PR5}

The input sequence is reduced to:

{PR1 PR1 PR2}

In this new model, there is a continuation for {PR1 PR1 PR2}, which is PR3.

Because the preferred model keeps track of the index of the data in the input sequences (and not the actual reduction functions), it becomes possible to generate the note corresponding to PR3, that is G in the present case.

Once the continuation has been found, the process is started again with the new sequence, using the more refined reduction function.

More precisely, there is introduced a hierarchy of reduction functions, to be used in a certain order in cases of failure. This hierarchy can be defined by the user. Typically, a useful hierarchy can be:

1—pitch*duration*velocity,

2—small pitch region*velocity,

3—small pitch regions, and

4—large pitch regions where the numbering indicates the order in which the graphs are considered in cases of failure.

The proposed approach allows to take inexact inputs into account, with a minimum cost. The complexity of retrieving the continuations for a given input sequence is indeed very small as it involves only walking through trees, without any sophisticated form of search.

Musical Issues: Harmony, Transposition, Rhythm and Polyphony

Before describing how to turn the present model into a real time interactive system, there shall first be explained how to handle several important musical issues, which help to ensure that the generation is musically realistic.

Management of Harmony

Harmony is a fundamental notion in most forms of music, Jazz being a particularly good example in this respect. Chord changes play an important role in deciding whether notes are "right" or not. It is important to note that while harmony detection is extremely simple to perform for a normally trained musician, it is extremely difficult for a system to express and represent explicitly harmony information, especially in real time. The system according to the present embodiment solves this problem in three possible ways:

i) by allowing the musician to correct the system in case it goes too far out of tune, by simply playing a few notes (e.g. the third and fifth) and relaunching the system 1 in a new, correct, direction. To this end, the embodiment is designed to have a control mode that actually allows the system to take into account external harmonic information without unduly complicating the data representation scheme, as explained in the section "Biasing the Markov generation", and ii) because the system continuously learns, it eventually also learns the chord changes in the pattern base. For instance, playing tunes such as "So What" by Miles Davis (alternation of D minor and D# minor) creates in the long run patterns with this chord change.

Transposition

To accelerate learning, the learning process is systematically repeated with all transpositions of the input sequence. This ensures that the system will be able to learn patterns in all tonalities. The transposition is managed by the transposition unit 58 associated to the Markov model module 50.

Polyphony

Figure 6:
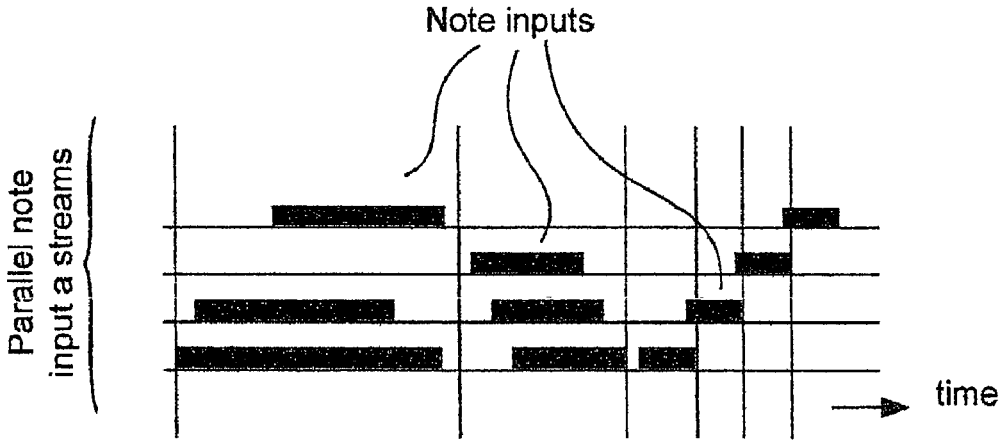
FIG. 6 is diagram showing an example of how the system of FIG. 1 handles polyphony with appropriate segmentation, with chords clustered and legato notes separated.

Polyphony refers to the fact that several notes may be playing at the same time, with different start and ending times. Because the model is based on sequences of discrete data, it has to be ensured that the items in the model are in some way independent, to be recombined safely with each other. With arbitrary polyphony in the input, this is not always the case, as illustrated in FIG. 6: some notes may not be stylistically relevant without other notes sounding at the same time. In this figure, notes are symbolised by dark rectangles bounded horizontally against a time axis. Concurrent notes appear as a superposition in a vertical axis, representing concurrent note input streams.

There has been proposed a scheme for handling polyphony (cf. Assayag, G., Delerue, O. "Guessing the composer's mind: applying universal prediction to musical style", Proc. ICMC 99, Beijing, China, I.C.M.A.,San-Francisco, 1999 consisting of slicing up the input sequence according to every event boundary occurring in a voice. This scheme is satisfactory in principle, in that it allows to model intricate contrapuntal relationships between several voices. However, the preferred embodiment advantageously uses a specific and simplified model that is better adapted to the properties of real interactive music. This model is managed by the polyphony management unit 60 associated to the Markov model module 50

The polyphony management unit 60 first applies an aggregation scheme to the input sequence, in which are aggregated clusters of notes sounding approximately "together". This situation is very fiequent in music, for instance with the use of pedals. Conversely, to manage legato playing styles, the polyphony management unit 60 treats slightly overlapping notes as actually different (see the end of the FIG. 6) by considering that an overlap of less than a few milliseconds is only the sign of legato, not of an actual musical cluster.

These cases can be troublesome at the generation phase, because some delay can be introduced if the sequence of notes is simply regenerated as contiguous notes. To cope with this situation, the respective inter-note delays are memorised by the polyphony management unit 60 such that the original overlap of the legato notes can be introduced again at the generation phase.

Rhythm

Rhythm refers to the temporal characteristics of musical events (notes, or clusters). Rhythm is an essential component of style and requires a particular treatment provided by the rhythm management unit 62 associated to the Markov model module 50. In the present context, it is considered in effect that musical sequences are generated step by step, by reconstructing fragments of sequences already parsed. This assumption is however not always true, as some rhythms do not afford reconstruction by arbitrarily slicing bits and pieces. As FIG. 6 illustrates, the standard clustering process does not take the rhythmic structure into account, and this may lead to strange rhythmical sequences at the generation phase.

This problem has no universal answer, but different solutions according to different musical contexts. Nevertheless, after conducting experiments with Jazz and popular music musicians, the Applicant has devised three different modes, programmed into the rhythm management unit 62, which the user can select freely:

1. Natural rhythm: the rhythm of the generated sequence is the rhythm as it was encountered during the learning phase. In this case, the generation explicitly returns the temporal structure as it was learned, and in particular "undoes" the aggregation performed and described in the previous section.

2. Linear rhythm: this mode consists in generating only eight-note streams, that is with a fixed duration and all notes concatenated. This allows generating very fast and impressive phrases, and is particularly useful in the "be-bop" style.

3. Input rhythm: in this mode, the rhythm of the output is the rhythm of the input phrase, possibly warped if the output is longer than the input. This allows to create continuations that sound like imitations from a rhythmic standpoint.

4. Fixed metrical structure: for popular and heavily rhythmic music, the metrical structure is very important and the preceding modes are not satisfactory. It has been suggested by Conklin Conklin, D. and Witten, Ian H. "Multiple Viewpoint Systems for Music Prediction", JNMR, 24:1, 51–73, 1995 to use the location of a note in a bar as yet another viewpoint, but this scheme forces to use quantisation, which in turn raises many issues that are intractable in an interactive context.

Figure 7:
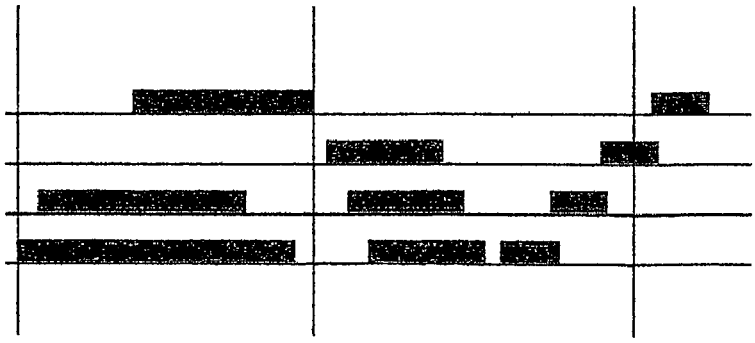
FIG. 7 is a diagram showing an example of how the system of FIG. 1 handles polyphony with fixed segmentation.

Instead, the preferred embodiment proposes in this mode to segment the input sequences according to a fixed metrical structure, as opposed to the temporal structure of the input. The metrical structure is typically given by an external sequencer, together with a given tempo, through Midi synchronisation. For instance, it can be four beats, with a tempo of 120. In this case, the segmentation ensures that notes are either truncated at the ending of the temporal unit when they are too long, or shifted to the beginning of the unit if they begin too early. This handling is illustrated by FIG. 7, which uses a representation analogous to that of FIG. 6.

Turning the Generator into an Instrument

The learning and generation modules, resp. 2 and 4 described in the preceding sections are able to generate music sequences that sound like the sequences in the learnt corpus. As such, this provides a powerful musical automaton able to imitate styles faithfully, but not a musical instrument. This section describes the main design concepts that allow to turn this style generator into an interactive musical instrument. This is achieved through two related constructs:

1. a step-by step generation of the music sequences achieved through a real time implementation of the generator, and 2. a modification of the basic Markovian generation process by the adjunction of a fitness function which takes into account characteristics of the input phrase.

The latter construct concerns the biasing of the continuation as it is being played through external music data inputs at the harmonic control module 64, and is an advantageous option of the musical instrument when used to generate a continuation in an environment where a musician is susceptible of playing alongside during the continuation and/or wishes to remain the master of how the musical piece is to evolve.

Real Time Generation

Real time generation is an important aspect of the system since it is precisely what allows to take into account external information quickly, and ensure that the music generated follows accurately the input, and remains controllable by the user.

For an estimation of the real time constraints envisaged for the preferred embodiment, it is useful to know how fast a musician can play. This has been conducted from an example by the musician John McLaughlin, considered as one of the fastest guitarist in the world, in an example performed for a demo of a pitch to Midi converter (cf. web site http://www.musicindustries.com/axon/archives/john.htm). An analysis of the fastest parts of the sample yields 18 notes in 1.189 seconds, that is a mean duration of 66 milliseconds per note. Of course, this figure is not definitive, but can be taken as an estimate for a reasonable maximum speed. The preferred embodiment will then aim for a response time short enough so that it is impossible to perceive a break in the note streams, from the end of the player's phrase, to the beginning of the system's continuation: a good estimation of the maximum delay between two fast notes is about 50 milliseconds.

Thread Architecture

Figure 8:
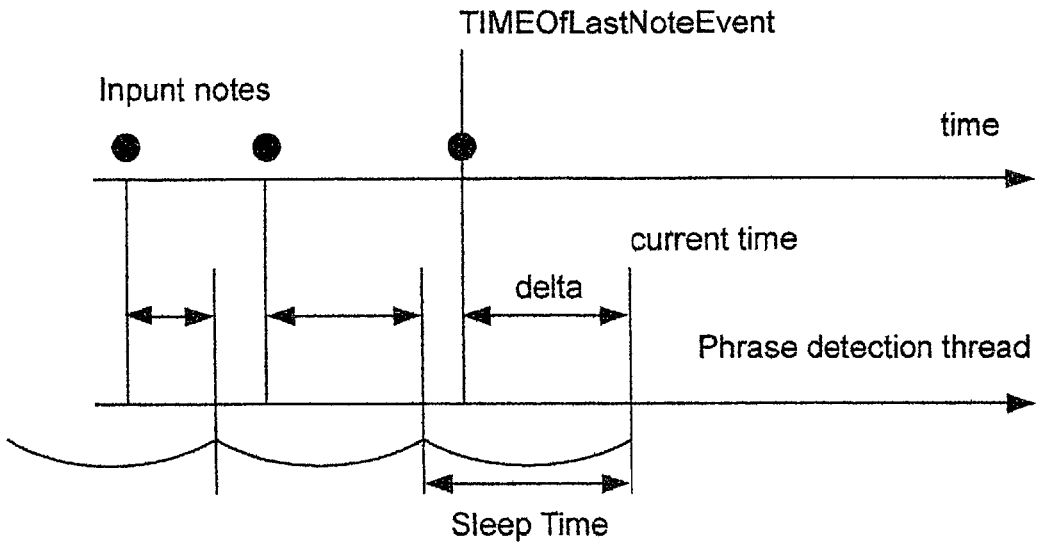
FIG. 8 is a diagram showing an input phrase detection process for incoming notes to the system of FIG. 1.

The real time aspect of the system is handled at the level of the phrase extractor 38, the latter being operative both in the learning phase and in the continuation phase. Incoming notes for which a continuation is to be generated are entered through the Midi input interface 12 and detected using the interruption polling process of the underlying operating system: each time a note event is detected, it is added to a list of current note events. Of course, it is impossible to trigger the continuation process only when a note event is received. To detect phrase endings, the embodiment introduces a phrase detection thread which periodically wakes up and computes the time elapsed between the current time and the time of the last note played. This elapsed time delta is then compared with a phraseThreshold value, which represents the maximum time delay between successive notes of a given phrase. If the time delta is less than phraseThreshold, the process sleeps for a number SleepTime of milliseconds. If the time delta is not less than phraseThreshold, an end of phrase is detected and the continuation system is triggered, which will compute and schedule a continuation. The phrase detection process is represented in FIG. 8.

In other words, each time the phrase detection thread wakes up at time t, it computes the current time delay delta on the following basis:

delta:=currentTime—timeOfLastNoteEvent

If then compares this delay with the phrase threshold, decides whether or not to detect a phrase ending, and schedules itself to wake up at t+SleepTime:

If (delta>=phraseThreshold) then detectPhrase( );

Sleep (SleepTime)

The real time constraint to be implemented is therefore that the continuation sequence produced and played by the system is preferably played with a maximum of 50 milliseconds after the last note event. The delay between the occurrence of the last note of a phrase and the detection of the end of the phrase is bounded by the value of SleepTime.

The embodiment uses a value of 20 milliseconds for SleepTime, and a phraseThreshold of 20 milliseconds. The amount of time spent to compute a continuation and to schedule that continuation is on average 20 milliseconds, so the total amount of time spent to produce a continuation is in the worse case 40 milliseconds, with an average value of 30 milliseconds. These values fit in the scope of the chosen real time constraint.

The value of phraseThreshold can advantageously be made a dynamic variable so as to accommodate to different tempos. This can be effected either by a user input setting through a software interface and/or preferably on an automatic basis. In the latter case, an algorithm is provided to measure the time interval between successive items of recently inputted music data and to adapt the value of phraseThreshold accordingly. For instance, the algorithm can calculate continuously a sliding average of the last j above time intervals (j being an arbitrarily chosen number) and use that current average value as the value of phraseThreshold. In this way, the system will successfully detect the interruption of a musical to be continued even if its tempo/rhythm changes.

As explained above, this algorithm can also be implemented to identify the corresponding phraseThreshold in the learning phase, to identify more reliably and accurately the ends of successive input sequences in the phrase extractor 38.

Step-by-Step Generation Process

Figure 9:
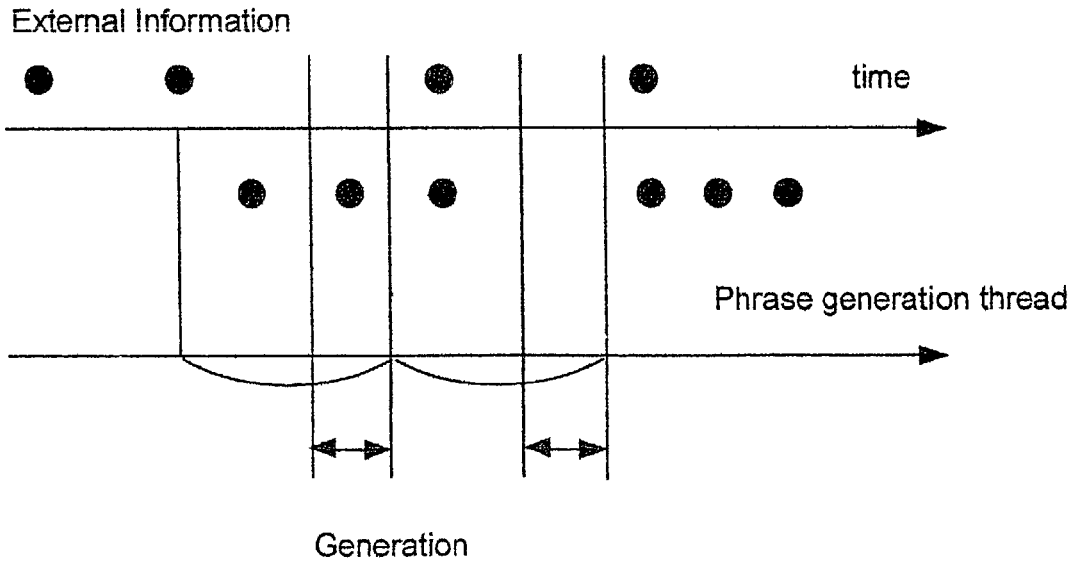
FIG. 9 is a diagram showing a step-by-step generation process produced by the system of FIG. 1, that takes into account external information continuously.

The second important aspect of the real time architecture is that the generation of musical sequences is performed step-by step, in such a way that any external information can be used to influence the generation (cf. next section). The generation is performed by a specific thread (generation thread), which generates the sequence by chunks. The size of the chunks is parameterized, but can be as small as one note event. Once the chunk is generated, the thread sleeps and wakes up for handling the next chunk in time. The step-by-step generation process that allows to continuously take into account external information is shown in FIG. 9.

Biasing the Markov Generation

The main idea to turn the system 1 into an interactive system is to influence the Markovian generation by characteristics of the input. As explained above, the very idea of Markov-based generation is to produce sequences in such a way that the probabilities of each item of the sequence are the probabilities of occurrences of the items in the learnt corpus.

In the context of musical interaction, this property is not always the right one, because many things can happen during the generation process. For instance, in the case of tonal music, the harmony can change. Typically, in a Jazz trio for instance, the pianist will play chords which have no reason to be always the same, throughout the generation process. Because the embodiment targets a real world performance context, these chords are not predictable, and cannot be learnt by the system prior to the performance. The system should nevertheless take this external information into account during the generation, and twist the generated sequence in the corresponding directions. This aspect of the system's operation is managed by the above harmonic control module 64 operatively connected to the random draw and weighting module 56 and responsive to external harmonic commands from the harmonic control mode input 66.

The idea is to introduce a constraint facility in the generation phase. External information may be sent as additional input to the system via the harmonic control mode input 66. This information can be typically the last for eight notes (pitches) played on a piano 68 for instance, if it is intended that the system should follow harmony. It can also be the velocity information of the whole band, if it is intended that the system should follow the amplitude. More generally, any information can be used to influence the generation process. This external input at 66 is used to influence the generation process as follows: when a set of possible continuation nodes is computed (cf. section on generation), instead of choosing a node according to its Markovian probability, the random draw, weighting and selection unit 56 weights the nodes according to how they match the external input. For instance, it can be decided to prefer nodes whose pitch is in the set of external pitches, to favour branches of the tree having common notes with the piano accompaniment.

In this case, the harmonic information is provided implicitly, in real time, by one of the musicians (possibly the user himself), without having to explicitly enter the harmonic grid or any symbolic information in the system.

More specifically, the systems considers a function Fitness(x, Context) with value in the range [0, 1], which represents how well item x fits with the current context. For instance, a Fitness function can represent how harmonically close is the continuation with respect to external infonnation at input 66. If it is supposed that the piano data contains the last 8 notes played by the pianist for instance (and input to the system), Fitness can be defined as:

Fitness (x, piano)=No. of note common to x and piano/No. of notes in x.

Of course, the "piano" parameter can be replaced by any other suitable source depending on the set-up used.

This fitness scheme is of course independent of the Markovian probability defined above. There is therefore introduced a specific weighting scheme which allows to parameterize the importance of the external input, via a parameter S (between 0 and 1):

$$\text{Prob}(x)=S*\text{Markov_Prob}(x)+(1-S)*\text{Fitness}(x, \text{Context})$$

By setting S to extreme values, there are eventually obtained two extreme behaviours:

i) S=1, producing a musical automaton insensitive to the musical context, ii) S=0, producing a reactive system which generates the closest musical elements to the external input it finds in the database.

Of course, intermediate values are interesting: when the system generates musical material which is both stylistically consistent, and sensitive to the input.

Thus, when a set of possible continuation nodes is computed using the tree structure, as described above, instead of choosing a node according to its weight (probability), the random draw, weighting and selection unit 56 is set to weight the nodes according to how they match the notes presented at the external input 66. For instance, it can be decided to give preference to nodes whose pitch is included in the set of external pitches, to favour branches of the tree having common notes with the piano accompaniment. In this case, the harmonic information is provided in real time by one of the musicians (e.g. the pianist), without intervention of the user, and without having to explicitly enter the harmonic grid in the system. The system then effectively matches its improvisation to the thus-entered steering notes.

This matching is achieved by a harmonic weighting function designated "Harmo_prob" and defined as follows.

Consider a set of external notes, designated Ctrl, entered into the harmonic control module 64 through input 66. These notes Ctrl are taken to correspond to the last n notes entered at input 54, coming e.g. from a piano 68, while Midi input interface 12 is connected to a guitar 10 and the synthesiser 18 that is connected to the Midi output interface 16 is a guitar synthesiser.

Consider now the set of pitches represented by node X, designated notes(X). The harmonic weighting function for notes(X) can then be expressed as:

$$\text{Harmo_prob} \equiv (\text{notes}(X) \cap \text{Ctrl})/|\text{notes}(X)|$$

If X is a note (and not a chord), then |X|=1 and Harmo_prob(x)=0 or 1.

If X is a chord, then Harmo_prob(x) belongs to [0, 1], and is maximal (1) when all the notes of X are in the set of external notes.

There is then defined a new function for choosing the next node in the tree. Consider 1) Tree prob(X), the probability of X in the tree, and 2) Harmo_prob (X), the harmonic weighting function, which assigns a weight to node X in the tree, representing how close the node matches an external input. Both Tree_prob and Harmo_prob assign values in [0, 1]. The aim is to achieve a compromise between these two weighting schemes. To introduce some flexibility, the system 1 adds a parameter S that allows tuning the total weighting scheme, so that the weight can take on a range of intermediate values between two extremes. When S=0, the weighting scheme is equal to the standard probability-based weighting scheme. When S=1, the weighting scheme is equivalent to the harmonic function.

The weight function is therefore defined as follows, where X is a possible node:

$$\text{Weight}(X) \equiv (1-S)*\text{Tree_prob}(X)+S*\text{Harmo_prob}(X).$$

Finally, the system 1 introduces a "jumping procedure", which allows to avoid a drawback of the general approach. Indeed, it may be the case that for a given input subsequence seq, none of the possible continuations have a non-zero Harmo_prob value. In such a case, the system 1 introduces the possibility to "jump" back to the root of the tree, to allow the generated sequence to be closer to the external input. Of course, this jump should not be made too often, because the stylistic consistency represented by the tree would otherwise be broken. The system 1 therefore performs this jump by making a random draw weighted by S, as follows:

If Weight(X)≦S, and

If the value of the random draw is less than S

Then make a jump, that is restart the computation of the next node by taking the whole set of notes of the tree, rather than the natural continuation of seq.

Experiments in these various modes are described below in the Experiment Section.

Control Parameters

To allow an intimate and non-intrusive control, the Applicant has identified a set of parameters that are easy to trigger in real time, without the help of a graphical interface. The most important parameter is the S parameter defined above, which controls the "attachment" of the system to the external input. The other parameters are "learn on/off", to set the learning process on or off, "continuation on/off" to tell the system to produce continuations of input sequences or not, and "superposition on/off", to tell the system whether it should stop its generation when a new phrase is detected, or not. The last control is particularly useful. By default, the systems stop playing when the user does, to avoid superposition of improvisations. With a little bit of training, this mode can be used to produce a unified stream of notes, thereby producing an impression of seamlessness between the sequence actually played by the musician and the one generated by the system. These controls are implemented with a foot controller.

Additionally, a set of parameters can be adjusted from the screen, such as the number of notes to be generated by the system (as a multiplicative factor of the number of notes in the input sequence), and the tempo of the generated sequence (as a multiplicative factor of the tempo of the incoming sequence).

By default, the system stops playing when the user starts to play or resumes, to avoid superposition of improvisations. With a little bit of training, this mode can be used to produce a unified stream of notes, thereby producing an impression of seamlessness. In other words, the system 1 takes over with its improvisation immediately from the point where the musician (guitar 10) stops playing, and ceases instantly when the musician starts to play again. These controls are implemented with a foot controller of the Midi connector box 14 when enabled by the basic controls on screen (tick boxes).

As shown in FIG. 1, when the system 1 is silent owing to the presence of music output from the instrument 10, it continues to analyse that output as part of its continuing learning process, as explained above. An internal link L2 is active in this case to also send the music output of the instrument from the Midi input interface 12 to the Midi output interface 16, so as to allow the instrument to be heard through the Midi synthesiser 18, sound reproduction system 20 and speakers 22.

Figure 10:
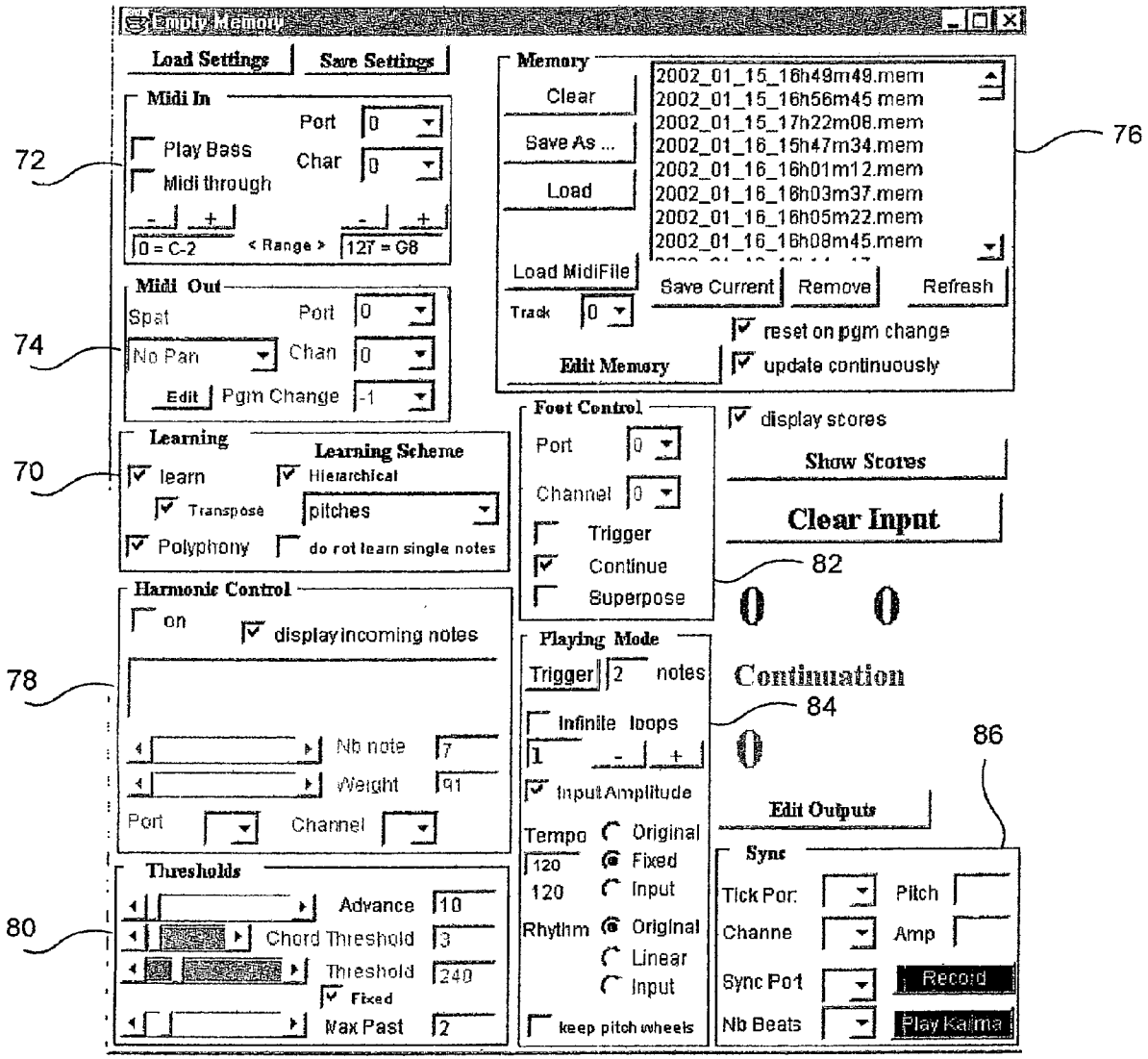
FIG. 10 shows an on-screen interface for accessing control parameters of the system of FIG. 1.

FIG. 10 shows an example of a graphic interface for setting various controllable parameters of the system 1 through the keyboard 34 or mouse 36.

Among the different controllable parameters are the following basic controls:

"learn on/off" (tick box 70), to set the learning process on or off, and to selectively enable the management of polyphony (unit 60), hierarchies, transpositions, etc., Additionally the software interface allows a set of parameters to be adjusted from the screen 32, such as:

Midi Input settings for the input interface 12 (box 72),

Midi Output settings for the output interface 16 (box 74),

Database 42 memory management parameters for saving data, resetting, loading new files, etc. (box 76), Input parameters for the harmonic control module 64, allowing the user to select the number of notes to be considered at a time at the harmonic control node input 66, to set the weighting coefficient for the influence of the external harmonic control on the improvised continuation, etc. (box 78), Thresholds for the parameters that establish the processing of chords (box 80), Foot control settings (box 82), Playing mode parameters : tempo, rhythm, amplitude, etc. (box 84), and Synchronisation conditions for external equipment (box 86).

EXPERIMENTATIONS

The Applicant has conducted a series of experimentations with system, in various modes and configurations. There are basically two aspects that can be assessed:

1. the musical quality of the music generated, and
2. the new collaborative modes the system allows.

Each of these aspects are reviewed in the following sections.

Musical Quality

It is difficult to describe music by words, and rate its quality, especially with jazz improvisation. However, it is easy to rate how the system differs from the human input. The Applicant has conducted tests to check whether listeners could tell when the system is playing or not. In most of the cases, if not all, the music produced is indistinguishable from the user's input. This is typically true for quick and fast solos (keyboard or guitar).

Concerning fixed metrical structure, experiments in various styles of the "Karma" music workstation were recorded. In these experiments, the Applicant connected the system according to the preferred embodiment to a "Korg Karma" workstation, both in input and output. The system is used as an additional layer to the Kanna effect engine. The system is able to generate infinite variations from simple recordings of music, in virtually all the styles proposed by the Karma workstation (over 700).

New Musical Collaborative Musical Modes

An interesting consequence of the design of the system is that it leads to several new playing modes with other musicians. Traditionally, improvised music has consisted in quite limited types of interaction, mostly based around question/answer systems. With the system in accordance with the invention, new musical modes can be envisaged, such as:

Single autarcy, where one musician plays with the system after having fed the system with a database of improvisations by a famous musician, as Midi files;

Multiple autarcy, where each musician has his/her own version of the system, with its own music pattern database 42. This provides a traditional setting in which each musician plays with his/her own style. Additionally, the Applicant experimented in the mode with improvisations in which one musician had several copies of the system 1 linked to different midi keyboards. The result for the listener is a dramatic increase in musical density. For the musician, the subjective impression ranges from a "cruise" button with which he/she only has to start a sequence and let the system continue, to the baffling impression of a musical amplifying mirror;

Master/Slave, where a first musician uses the system in its basic form, and a second musician (e.g. a pianist) provides the external data to influence the generation. This is typically useful for extending a player's solo ability while following the harmonic context provided by another musician. Conversely, the system can be used as an automatic accompaniment system which follows the user. In this configuration, the continuation system is given a database of chord sequences, and the input of the user is used as the external data. Chords are played by the system so as to satisfy simultaneously two criteria:

1) continuity, as given by the learnt corpus (e.g. two fives, harmonic cadenzas, etc.), and 2) closeness to the input. The samples show clearly how the user tries to fool the system by playing quick transposition and strange harmonies. In all cases, the continuation system finds chords that match the input as closely as possible. A particularly striking example is a Bach prelude (in C) previously learnt by the system, and used for the generation of an infinite stream of arpeggios. When the user plays single chords on a keyboard, the arpeggios instantaneously "follow" the chords played.

Cumulative, where all musicians share the same pattern database;

Sharing: each musician plays with the pattern database of the other (e.g.; piano with guitar, etc.). This creates exciting new possibilities as a musician can experience playing with unusual patterns.

Figure 11:
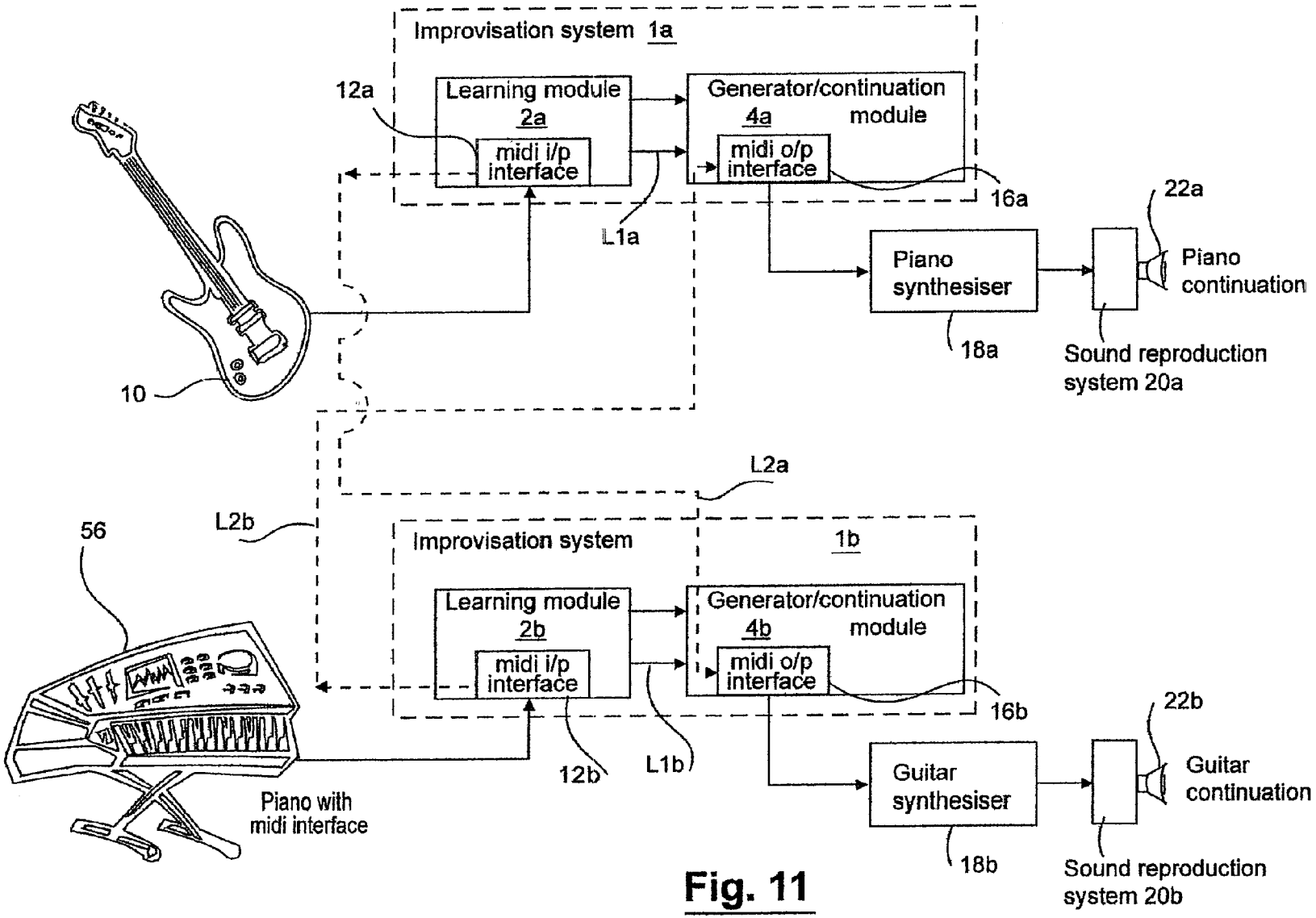
FIG. 11 is a diagram showing how several systems of FIG. 1 can be interconnected to implement a sharing mode of operation.

FIG. 11 shows an example of a set-up for the sharing mode in the case of a guitar and piano duo (of course, other instruments outside this sharing mode can be present in the music ensemble). Here, each instrument in the sharing mode is non acoustic and composed a two functional parts : the played portion and a respective synthesiser. For the guitar, these portions are respectively the main guitar body 10 with its Midi output and a guitar synthesiser 18*b*. For the piano, they are respectively the main keyboard unit with its Midi output 56 and a piano synthesiser 18*a*.

Two improvisation systems 1*a* and 1*b* as described above are used. The elements shown in FIG. 11 in connection with these systems are designated with the same reference numerals as in FIG. 1, followed by an "a" or "b" depending on whether they depend from improvisation system 1*a* or 1*b* respectively.

One of the improvisation systems 1*a* has its Midi input interface 12*a* connected to the Midi output of the main guitar body 10 and its Midi output interface 16*a* connected to the input of the piano synthesiser 18*a*. The latter thus plays the improvisation of system 1*a*, through the sound reproduction system 20*a* and speakers 22*a*, based on the phrases taken from the guitar input.

The other improvisation system 1*b* has its Midi input interface 12*b* connected to the Midi output of the main keyboard unit 56 and its Midi output interface 16*b* connected to the Midi input of the guitar synthesiser 18*b*. The latter thus plays the improvisation of system 1*b*, through the sound reproduction system 20*b* and speakers 22*b*, based on the phrases taken from the piano input.

This inversion of synthesisers 18*a* and 18*b* is operative all while the improvisation is active. When a musician starts playing, the improvisation is automatically interrupted so that his/her instrument 10 or 56 takes over through its normally attributed synthesiser 18*b* or 18*a* respectively. This taking over is accomplished by adapting link L2 mentioned supra so that a first link L2*a* is established between Midi input interface 12*a* and Midi output interface 16*b* when the guitar 10 starts to play, and a second link L2*b* is established between Midi interface 12*b* and Midi output interface 16*a* when the piano 56 starts playing.

Naturally, this concept of connecting the inputs 6 and outputs 8 of the system to different instruments can extrapolated to any number n of improvisation systems, the choice of instruments involved being arbitrary.

Note that the above description considers a real-time input of midi items. This input can be also any MidiFile, or set of Midifiles. These files can be for instance music pieces by a given author, style, etc. Conversely, the learnt structure (the trees) can be saved during or at the end of a session. These saved files themselves are organized in a library, and can be loaded later. It is this save/load mechanism which makes it possible for arbitrary users to play with musicians who are not physically present.

Learned tree structures can for instance be stored on a data medium that can be transported and exchanged between musicians and instruments. They can also be downloaded from servers. A tree structure can also be entered into a pool, allowing different musicians to contribute to its growth and development, e.g. through a communications network.

The invention can be embodied in wide variety of forms with a large range of optional features. The implementation described is based largely on existing hardware elements (computer, Midi interfaces, etc.), with the main aspects contained in software based modules. These can be integrated in a complete or partial software package in the form of a suitable data carrier, such as DVD or CD disks, or diskettes that can be loaded through the appropriate drives 28, 30 of the PC.

Alternatively, the invention can be implemented as a complete stand-alone unit integrating all the necessary hardware and software to implement a complete system connectable to one or several instruments and having its own audio outputs, interfaces, controls etc.

Between these two extremes, a large number of software, firmware and hardware embodiments can be envisaged.

Finally, it is clear that music data protocols other than Midi can be envisaged.

Likewise, the teachings of the invention accommodate for all sorts of music styles, categories, and all sorts of musical instruments, those mentioned with reference to the figures being mere examples.

What is claimed is:

1. A method of automatically generating music from learnt sequences of music data acquired during a learning phase, wherein it generates music as a real time continuation of an input sequence of music data, the method having a continuation phase comprising the steps of:

detecting the occurrence of an end of a current input sequence of music data (12), and starting to generate said continuation upon said detected occurrence of an end of a current input sequence of music data.

2. Method according to claim 1, further comprising the steps of determining a data rate of said current input sequence of music data and of timing the start of said continuation substantially in phase with the determined data rate such that the transition from an end of said current input sequence to the starting of said continuation is substantially continuous.

3. Method according to claim 1, wherein a start portion of said generated continuation is selected from a learnt input sequence which contains the terminal portion of the current input sequence up to said detected end and which has an identified continuation therefor, when such a learnt sequence is found to exist, such that a concatenation of said terminal portion and said start portion forms a data sequence contained in said learnt sequence.

4. Method according to claim 1, wherein said learning phase comprises establishing a data base of music patterns (42) which is mapped by a tree structure (T) having at least one prefix tree (T1, T2, T3), said tree being constructed by the steps of:

identifying (38) sequences of music data elements from music data elements received at an input (6), producing a tree corresponding to at least one prefix of that sequence, entering the continuation element for that prefix as an index associated to at least one node of the prefix tree.

5. Method according to claim 4, the prefix tree (T1, T2, T3) is constructed by parsing the prefix in reverse order relative to the time order of the music sequence, such that a latest music data item in the prefix is placed at the point of access to the tree when said tree is consulted.

6. Method according to claim 4, further comprising a steps of assigning to at least one node of the prefix tree structure (T) a label that corresponds to a reduction function of the music data for that node.

7. Method according to claim 4, wherein same input sequences are used construct a plurality of different tree structures, each tree structure corresponding to a specific form of reduction function.

8. Method according to claim 6, wherein said label assigned to a prefix tree (T) is a freely selectable reduction function.

9. Method according to claim 8, wherein a pitch region is treated as a selectable reduction function.

10. Method according to claim 1, wherein said learning phase includes a step of establishing a data base of music patterns (42) which comprises a step of creating an additional entry into said data base for at least one transposition (58) of a given input sequence to enable learning of said pattern in multiple tonalities.

11. Method according to claim 4, characterised in that said continuation phase comprises the step of walking through (52) said tree structure (T) along a path yielding all continuations of a given input sequence to be completed, to produce one or more sequences which have substantially the same Markovian distributions.

12. Method according to claim 7, further comprising, during said continuation phase, the step of identifying which tree structure among the plurality of tree structures provides an optimal continuation for a given continuation sequence, and of using that identified tree structure to determine said continuation sequence.

13. Method according to claim 5, comprising the steps, during said continuation phase, of:

searching for matches between music data items at successive nodes of a tree and corresponding music data items of the sequence to be continued, the latter being considered in reverse time order, starting with the last data item of the sequence to be continued, reading data at the node of a prefix tree where the last successful match has been found at the searching step, said data indicating the music data element that follows the prefix formed by the matching data element(s) found in the searching step, for at least one learnt sequence of the database (42), and selecting a continuation music data element from at least one music data element indicated by said data.

14. Method according to claim 1, wherein, during said continuation phase, in a case of an inexact string matching between the contents of the music patterns in the data base (42) and an input sequence to be continued on the basis of a first reduction function for the music data elements, the continuation is searched on the basis of a second reduction function which offers more tolerance than said first reduction function.

15. Method according to claim 14, wherein said second reduction function is selected according to a hierarchy of possible second reduction functions taken from the following list, given in the order which they are considered in case of said inexact string matching:

i) pitch and duration and velocity, ii) small pitch region and velocity, iii) small pitch regions, iv) large pitch regions.

16. Method according to claim 1, wherein during said learning phase, it further comprises the steps of:

detecting in a received sequence of music data the presence of polyphony, determining notes that appear together within predetermined limits, and aggregating said notes.

17. Method according to claim 1, wherein during said learning phase, it further comprises the steps:

detecting in a received sequence of music data the presence of notes that are overlapping in time, determining the period of overlap of said notes, identifying said notes as legato notes if said period of overlap is less than a predetermined threshold, and recording said identified legato notes as separated notes.

18. Method according to claim 17, wherein during said continuation, it further comprises the step of restoring the original overlap of notes in said notes that were recorded as separated as legato notes.

19. Method according to claim 1, wherein, during said continuation phase, it further comprises providing a management of temporal characteristics of musical events to produce a rhythm effect according to at least one of the following modes:

i) a natural rhythm mode, in which the generated sequence is produced with the rhythm of that sequence when acquired in said learning phase, ii) a linear rhythm mode, in which the generated sequence is produced in streams of a predetermined number of notes, with a fixed duration and said notes concatenated, iii) an input rhythm mode, in which the rhythm of the generated sequence is the rhythm of the sequence to be continued, possibly with warping to accommodate for differences in duration, iv) a fixed metrical structure mode, which the input sequences are segmented according to a fixed metrical structure and optionally with a determined tempo.

20. Method according to claim 1, wherein, during said continuation phase, it further comprises providing a management of temporal characteristics of musical events to produce a rhythm effect according to a fixed metrical structure mode, which the input sequences are segmented according to a fixed metrical structure and optionally with a determined tempo.

21. Method according to claim 1, wherein during a continuation phase, a music sequence being produced is caused to be influenced by concurrent external music data entered (664, 66), through the steps of:

detecting a characteristic of said entered music data; and selecting candidate continuations by their degree of closeness to said detected characteristic.

22. Method according to claim 21, wherein said concurrent external music data is produced from a source different from the source producing said current music data.

23. Method according to claim 1, wherein music patterns forming a data base originate from a source different from the source producing said current music data (4).

24. A device (1) for automatically generating music from learnt sequences of music data acquired during a learning phase, characterised in that it generates music as a real time continuation of an input sequence of music data, said device comprising:

means (12) for detecting the occurrence of an end of a current input sequence of music data, and means for starting to generate said continuation upon said detected occurrence of an end of a current input sequence of music data (4).

25. Device according to claim 24, operative during a continuation phase to allow a music sequence being produced to be influenced by concurrent external music data, said device further comprising:

input means (64, 66) for receiving said external music data and detecting a characteristic thereof; and means (56) for selecting candidate continuations by their degree of closeness to said detected characteristic.

26. A music continuation system, characterised in that it comprises:

a device according to claim 24, a first source of music data operatively connected to supply data to a data base, and a second source of music data (10) producing said current music data.

27. System according to claim 26, wherein said first source of audio data is music file data or an output from a musical instrument, wherein said second source of audio data is a musical instrument (10; 56).

28. A system according to claim 24, further comprising:

a first musical instrument (10) and a second musical instrument (56) different from said first musical instrument, wherein said first musical instrument is operatively connected as a source of data for a data base of music patterns of said first device and as a source of current music data for said second device, whereby said second device generates an improvisation with a sound of said first musical instrument referring to a data base produced from said second instrument, and said second musical instrument is operatively connected as a source of data for said data base of music patterns of said second device and as a source of current music data for said first device, whereby said first device generates an improvisation with a sound of said second musical instrument referring to a data base produced from said first instrument.

29. A computer program product directly loadable into the memory comprising software code portions for performing the steps of claim 1 when said product is run on a computer.

30. A method of automatically continuing a music input upon an interruption of the latter, comprising the steps of:

storing music information in terms of successive music data items acquired in a learning phase, receiving music data items of a musical input subject to an interruption, upon an interruption in said musical input, producing in response a real-time continuation thereof determined on the basis of a comparison between music data items forming a terminal portion of said musical input up to said interruption and said successive music data items acquired in a learning phase.

31. Method according to claim 30, further comprising the steps of determining the time interval between successive music data items of said musical input, and of timing the start of said continuation substantially in step with the determined time interval.

32. Method according to claim 30, wherein said real-time continuation is produced by:

identifying a match between music data elements of said terminal portion and a portion of the stored music data elements acquired in the learning phase, outputting as said continuation at least one music data item of said stored music data elements acquired in the learning phase that follows on from said matching portion thereof.

33. Method according to claim 30, further comprising the step of determining time interval data in respect of successive music data items of said received musical input, thereby to obtain a time criterion for determining when said interruption has occurred.

34. Method according to claim 30, wherein said musical input is received in real time from a musical instrument being played.

35. Method according to claim 30, further comprising a step of enriching said music item sequence information acquired in a learning phase with said received musical note information.

36. Method according to claim 30, wherein said successive musical data items constitute respective music events occurring in time succession, said music events being taken from:

musical notes, events expressible by the MIDI protocol or equivalent protocol.

37. A device for automatically continuing a music input upon an interruption of the latter, said device comprising:

means for storing music information in terms of successive music data items acquired in a learning phase, means for receiving music data items of a musical input subject to an interruption, means, upon an interruption in said musical input, for producing in response a real-time continuation thereof determined on the basis of a comparison between music data items forming a terminal portion of said musical input up to said interruption and said successive music data items acquired in a learning phase.

38. Device according to claim 37, further comprising means for determining the time interval between successive music data items of said musical input, and timing the start of said continuation substantially in step with the determined time interval.

39. Device according to claim 37, wherein said real-time continuation is produced by:

identifying a match between music data elements of said terminal portion and a portion of the stored music data elements acquired in the learning phase, outputting as said continuation at least one music data item of said stored music data elements acquired in the learning phase that follows on from said matching portion thereof.

40. Device according to claim 37, further comprising means for determining time interval data in respect of successive music data items of said received musical input, thereby to obtain a time criterion for determining when said interruption has occurred.

41. Device according to claim 37, wherein said musical input is received in real time from a musical instrument being played.

42. Device according to claim 37, further comprising means for enriching said music item sequence information acquired in a learning phase with said received musical note information.

43. Device according to claim 37, wherein said successive musical data items constitute respective music events occurring in time succession, said music events being taken from:

musical notes, events expressible by the MIDI protocol or equivalent protocol.

44. A computer readable medium having a program stored thereon for automatically continuing a music input upon an interruption of the latter, said program performing the steps of:

storing music information in terms of successive music data items acquired in a learning phase, receiving music data items of a musical input subject to an interruption, upon an interruption in said musical input, producing in response a real-time continuation thereof determined on the basis of a comparison between music data items forming a terminal portion of said musical input up to said interruption and said successive music data items acquired in a learning phase.

45. The method according to claim 19, wherein said fixed metrical structure is a sequencer.

46. The method according to claim 20, wherein said fixed metrical structure is a sequencer.

47. The method according to claim 21, wherein said characteristic of said entered music data is harmonic information.

48. The method according to claim 21, wherein said characteristic of said entered music data is velocity.

49. The method according to claim 21, wherein said concurrent external music data is produced from a musical instrument different from a musical instrwnent producing said current music data.

50. The method according to claim 23, wherein said source that said music patterns forming a data base originate from is music files.

51. The method according to claim 23, wherein the source producing said current music data is a musical instrument.

52. The method according to claim 25, wherein said characteristic of said entered music data is harmonic information.

53. The method according to claim 25, wherein said characteristic of said entered music data is velocity.

54. The system according to claim 26, wherein the second source of music data producing said current music data is a musical instrument.

55. The computer program according to claim 29, wherein said memory is an internal memory of a digital computer.

* * * * *